US008573170B2

(12) United States Patent
Sullivan et al.

(10) Patent No.: US 8,573,170 B2
(45) Date of Patent: Nov. 5, 2013

(54) ROCKER ARM ASSEMBLY WITH INTEGRATED SUPPORT PIN ANTI-INVERSION FEATURE

(75) Inventors: Mark Sullivan, Rochester Hills, MI (US); Jesse Myers, Waterford, MI (US); Richard Baker, Sterling Heights, MI (US); Lutz Kirbach, Herzogenaurach (DE); Michael Turner, Fort Mill, SC (US); James Westbrook, Oxford, MI (US); Benjamin McAuley, Rockingham, NC (US); William Carter, Cheraw, SC (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 160 days.

(21) Appl. No.: 13/222,400

(22) Filed: Aug. 31, 2011

(65) Prior Publication Data

US 2012/0060782 A1 Mar. 15, 2012

Related U.S. Application Data

(60) Provisional application No. 61/382,127, filed on Sep. 13, 2010.

(51) Int. Cl.
*F01L 1/18* (2006.01)

(52) U.S. Cl.
USPC ..... 123/90.39; 74/559

(58) Field of Classification Search
USPC ..... 74/559, 519; 123/90.39, 90.41
See application file for complete search history.

(56) References Cited

U.S. PATENT DOCUMENTS

| | | | | |
|---|---|---|---|---|
| 5,329,891 | A * | 7/1994 | Murphy et al. | 123/90.39 |
| 5,437,209 | A | 8/1995 | Santoro | |
| 6,694,936 | B2 | 2/2004 | Stallmann | |
| 2008/0098971 | A1 | 5/2008 | Baker et al. | |
| 2010/0037844 | A1 * | 2/2010 | Kinsey et al. | 123/90.39 |

* cited by examiner

*Primary Examiner* — Zelalem Eshete
(74) *Attorney, Agent, or Firm* — Lucas & Mercanti, LLP

(57) ABSTRACT

A rocker arm assembly which has an anti-inversion part that prevents a support pin from inverting and, thus, ensuring proper orientation of the support pin, on which a rocker arm is rotatably mounted, is maintained. The anti-inversion part can be incorporated on the support pin, the inner sleeve or the outer sleeve and/or a combination of the support pin, the inner sleeve and/or the outer sleeve.

18 Claims, 40 Drawing Sheets

ROCKER ARM ASSEMBLY WITH INTEGRATED SUPPORT PIN ANTI-INVERSION FEATURE

FIELD OF THE INVENTION

This invention relates to rocker arm assemblies for a valve train of an internal combustion engine and, more particularly, to an anti-inversion feature used in a pedestal mounted rocker arm assembly to ensure proper orientation of a support pin, on which a rocker arm is rotatably mounted, is maintained.

BACKGROUND OF THE INVENTION

Pedestal mounted rocker arm assemblies have a rocker aim rotatably mounted on a support pin which in turn is fixed to a cylinder head through a pedestal. The support pin is also known as a trunnion. Conventionally, the support pin rests on the pedestal, also known as a support block, which positions the overall rocker arm assembly away from the cylinder head. One end of the rocker arm is in contact with the push rod while the other end of the rocker arm is in contact with a valve shaft.

Roller bodies, also referred to as radial bearings, are conventionally used between the support pin and the rocker arm to facilitate rotational movement of the rocker arm on the support pin and to handle radial loads.

Moreover, an inner sleeve and an outer sleeve can be used. When incorporated into the rocker arm assembly, the inner sleeve and the outer sleeve are positioned between a through-hole in the rocker arm with the inner sleeve affixed to the support pin and the outer sleeve affixed to the rocker arm. Furthermore, the roller bodies are positioned between the inner sleeve and outer sleeve to accommodate radial loads.

Rocker arm assemblies can also be subject to axial forces or thrust forces. Axial forces occur when certain parts are out of alignment, for example, when the rocker arm pallet and the socket, the lower end of the push rod and the socket, or the valve shaft and the rocker arm pallet are out of alignment. Such rocker arm assemblies are often referred to as "offset rocker arm assemblies." Thrust forces occur at thrust surfaces. The thrust surfaces are present on the ends of the support pin and on the inner sleeve and outer sleeve adjacent to the ends of the support pin.

During a valve event, the push rod of the engine engages the rocker arm at an angle relative to the support pin centerline such that thrust and moment loads are generated with respect to the bearing axis, attempting to translate the rocker arm along the bearing axis. The loads resulting from the valve event vary as a function of engine speed, valve spring compression, and pushrod articulation during the valve event. The outer sleeve is fixed to the rocker arm and, therefore, translates with the rocker arm until contact is made with the inner sleeve, which is fixed to the support pin. The outboard flange on the inner sleeve experiences compressive loading imparted by the outer shell. The rolling elements carry radial forces generated by the combination of the pushrod and the valve spring during the valve event while permitting low friction articulation of the rocker arm for valve actuation.

To ensure the support pin, which typically has a flat upper surface and a concave lower surface that contacts the pedestal, does not become inverted prior to final installation a captured fastener is commonly affixed in a centrally located bore in the support pin. Essentially, a captured fastener is a washer that has a circular flange extending from one side of the washer with threading on the inside of the flange. A bolt is also typically inserted in the captured fastener and the bore prior to final assembly.

Furthermore, snap rings, wave springs, or diaphragm (Belleville) springs can be used to control the axial loads of a shaft assembly. Shaft assembly arms typically utilize journal bearing pivots, though needle bearing applications are also known. However, shaft assemblies usually require oil galleries for arm bearing lubrication which adds to the overall cost of the use of the snap ring or spring application.

Rocker arm assemblies utilizing a captured fastener are known, see, for example, U.S. Pat. No. 6,694,936 and U.S. Patent Application No. 2008/0098971. Such rocker arms employ a captured fastener and a fastening bolt to ensure the support pin does not become inverted prior to final installation of the rocker arm to the engine. The manufacturability of captured fasteners is challenging due to the precise flange geometry required for fastening with the bore of the support pin. Also, the use of the captured fastener and fastening bolt adds to the cost and packaging size of the rocker arm assembly. Furthermore, in certain instances, captured fasteners cannot be used.

Additionally, see, for example, U.S. Pat. No. 5,437,209, which discloses a rocker arm assembly. The support pin of the rocker arm assembly has a D-shaped feature at each end to prevent the support pin from inverting. The support pin engages in a D-shaped hole stamped into the outer bearing sleeve, coupled with an inner bearing sleeve that has a specified range of diametric clearances to the support pin journal, preventing the support pin from inverting. However, the design only applies to an inner sleeve that has a clearance to the support pin, the manufacturability is costly due to intricacies of the design, and the time consuming assembly.

SUMMARY OF THE INVENTION

The present invention is directed to an anti-inversion feature that is incorporated into a rocker arm assembly to ensure the support pin remains in an upright position and will not become inverted between initial assembly and final installation in an internal combustion engine.

In one embodiment, the anti-inversion feature is an axial protrusion, or tab, outboard of the rocker arm assembly that is incorporated into one or both ends of the support pin. A hole is present in thrust surfaces of the inner sleeve and the outer sleeve which allow the protrusion to extend outboard of the rocker arm assembly. The protrusion's geometry is configured such that angular motion of the protrusion is intentionally limited by contact with at least one wall of the hole formed in the outer sleeve. Limiting the angular motion of the support pin prevents the support pin from inverting. By only incorporating the tab on one side of the support pin, the assembly orientation tooling required is minimized.

In another embodiment of the present invention, the anti-inversion feature includes a tab formed on the inner sleeve that extends in a generally axial outboard direction away from the longitudinal centerline of the rocker arm, and rests in a recess formed in the outer sleeve. Around the recess, the outer sleeve bulges outward in an extruded area to accommodate the recess. The shapes of the space on the outer sleeve and the protrusion on the inner sleeve allow for sufficient clearance to avoid impeding the articulation of the rocker arm during the valve event, while keeping the support pin from completely inverting. Also, a through hole is incorporated into the outboard flange of the inner sleeve to prevent air from being trapped when the sleeve is assembled, or pressed onto the rocker arm assembly and to provide an oil reservoir for the thrust surfaces. Moreover, any suitable combination of inner sleeve and outer sleeve geometries can be used.

In a derivation of the embodiment, the anti-inversion feature can include a tab formed on the inner sleeve that extends in a generally axial outboard direction away from the longitudinal centerline of the rocker arm. A hole of the outer sleeve allows the tab of the inner sleeve to extend outboard of the rocker arm assembly. The tab's geometry is configured such that angular motion is intentionally limited by contact of the tab of the inner sleeve with at least one wall of a hole formed in the outer sleeve. Limiting the angular motion of the support pin prevents the support pin from inverting. By only incorporating the tab on one end of the inner sleeve, the assembly orientation tooling required is minimized.

In another derivation of the embodiment, the anti-inversion feature can be incorporated onto the outer sleeve by forming a tab in a locally extruded area that extends in a generally axial inboard direction, toward the longitudinal centerline of the rocker arm. The tab engages the edges of a suitably designed recess or hole formed in the inner sleeve, preventing inversion of the support pin.

In a further embodiment of the present invention, the anti-inversion feature can includes a hole in the outer bearing sleeve from which a tab is formed and folded in a generally axial direction inward, toward the longitudinal centerline of the rocker arm, through a hole in the inner sleeve and into a recess formed in a journal end of the support pin. The recess can have sufficient clearance to avoid impeding the articulation of the rocker arm during a valve event while preventing inversion of the support pin by contact with one of the recess walls. Preferably, the ends of the support pin are of different geometries such that only one recess limits the rocker arm articulation by contact with the outer sleeve tab, minimizing costly assembly orientation tooling. The other recess would permit unlimited rotation of the support pin. Alternatively, articulation limiting geometry could be incorporated into both recesses in the ends of the support pin.

In yet a derivation of the further embodiment, the anti-inversion feature may include a hole in the inner sleeve from which a tab could be formed and folded in a generally axial direction away from the longitudinal centerline of the rocker arm, through a hole incorporated into the thrust surfaces of the outer sleeve. The hole of the outer sleeve is configured such that the angular motion of the tab of the inner sleeve is intentionally limited by contact with edges of the hole of the outer sleeve, thus preventing inversion of the support pin.

In an yet another a derivation of the further embodiment, the anti-inversion feature may include holes that are incorporated into the thrust surfaces of both the inner sleeve and outer sleeve from which tabs are formed and folded in a generally axial direction, in offset planes, away from the longitudinal centerline of the rocker arm. The geometries of the tabs and offset spacing are configured such that the angular motion of the inner sleeve relative to the tab of the outer sleeve is intentionally limited by contact of the tabs, preventing inversion of the support pin. The tabs can be formed on one or both sides of the rocker arm.

Preferably, for all embodiments, the hole in the outer sleeve is larger than the hole in the inner sleeve. This permits the bearing to be installed into the rocker arm as an assembly using a stepped tool. The stepped tool maintains a specified axial clearance between the inner bearing thrust surfaces and outer bearing thrust surfaces. Also, the stepped tool allows for a more cost effective assembly by minimizing the number of rocker arm assembly steps and allows for free rotation of the rocker arm. However, the protrusion and the holes in the inner sleeve and the outer sleeve can be of any shape which permits full motion of the rocker arm while still preventing inversion of the support pin.

Preferably, for all embodiments, an interference fit is also present between the inner sleeve and the support pin.

Additionally, for all embodiments, retention flanges can be formed on either the inner sleeve or the outer sleeve to retain the rolling bodies located between the inner sleeve and the outer sleeve. The flanges would help to maintain the orientation and, thus, functionality of the rolling elements. Also, while it is advantageous to incorporate a rolling element axial retention flange in each bearing sleeve, it is possible to incorporate both into a single bearing sleeve.

Furthermore, for all embodiments, etchings could be utilized on the thrust surfaces of support pin, inner sleeve and outer sleeve or either of the thrust surfaces of the outer sleeve or inner sleeve may be flat, contoured, crowned/domed or may include geometries to promote oiling and alleviate edge loading. Additionally, the outer sleeve thrust surface may act directly on the end of the support pin to reduce packaging size if the end surfaces have adequate hardness and the geometry is sufficiently designed, including flat, contoured and other geometries that might promote oiling and reduce edge loading of the thrust surfaces. Coatings may be applied to the thrust surfaces to modify friction characteristics and improve oil retention and durability. Such coatings may include, but are not limited to, various phosphates, Teflon®, and diamond-like coatings known as C+ and C++. A low friction washer made of Torlon®, Teflon®, graphite Oilite®, or other suitable material, may be incorporated between the thrust surfaces if needed as well.

Broadly, the present invention can be defined as a rocker arm assembly for use in an internal combustion engine which comprises a rocker arm which has a transverse through-hole; a support pin which has a body with a centrally located bore that is positioned in the through-hole and about which the rocker arm rocks; a bearing which is positioned at each end of the support pin in the through-hole between the support pin and the rocker arm with the bearing having an outer sleeve, an inner sleeve, and roller elements therebetween with the outer sleeve abutting an inner circumferential wall of the through-hole, and having an outer bearing wall that extends radially inward and covers the through-hole, the inner sleeve abutting an outer circumferential wall of the support pin, and having an inner bearing wall that extends radially inward and covers an axial end wall of the support pin, with the outer bearing wall abutting the inner bearing wall to accommodate axial loads and the rolling elements positioned between and in contact with the inner sleeve and outer sleeve to accommodate radial loads; and a means for preventing inversion of the support pin. The means for preventing inversion of the support pin is a combination of the support pin, the inner sleeve and the outer sleeve.

Preferably, the support pin can have a central section and two ends with the central section having a smooth, cylindrical surface and the ends, which are located on each side of the central section, being stepped and narrower in diameter than the central section. The support pin can be selected from a group consisting of a support pin where the ends are of flat or linear form, a support pin which has a tab extending from at least one of the ends of the support pin, and a support pin which has recesses in each of the ends of the support pin.

In one embodiment, the tab can be D-shaped and extends from a bottom half of at least one of the ends of the support pin. The tab of the support pin extends outboard of the rocker arm assembly through a hole in a thrust surface of the inner sleeve and a hole in a thrust surface of the outer sleeve. The hole in the outer sleeve is predominately cylindrical with a wave-like upper wall which has recesses at each end that acts as stops. The tab is configured such that angular motion of the tab is limited by contact with at least one of the recesses, preventing inversion of the support pin. Also, the hole in the outer sleeve is larger than the hole in the inner sleeve. Alternatively, the tab can extend from both of the ends of the support pin.

In another embodiment, the tab can be predominately rectangular and extend centrally from at least one of the ends of the support pin. The tab of the support pin extends outboard of the rocker arm assembly through a hole in a thrust surface of the inner sleeve and a hole in a thrust surface of the outer sleeve. The hole in the outer sleeve is predominately cylindrical with a convex upper wall that acts as a stop. The tab is configured such that angular motion of the tab is limited by contact with the upper wall, preventing inversion of the support pin. Also, the hole in the outer sleeve is larger than the hole in the inner sleeve. Alternatively, the tab extends from both of the ends of the support pin.

Preferably, an interference fit can be present between the inner sleeve and the support pin.

Preferably, retention flanges can be formed on the inner sleeve or the outer sleeve to retain the rolling bodies located between the inner sleeve and the outer sleeve. Alternatively, the retention flanges can be formed on both the inner sleeve and the outer sleeve to retain the rolling bodies located between the inner sleeve and the outer sleeve.

In a further embodiment, the tab, which can be of any shape, extends from at least one of the ends of the inner sleeve. The outer sleeve has a recess in which the tab rests and which is configured to limit angular motion of the tab by contact with at least one wall of the recess, preventing inversion of the support pin. To accommodate the recess, the outer sleeve forms a bulge that protrudes in an outboard direction. A through hole is incorporated into an outboard flange of the inner sleeve to prevent air from being trapped when the inner sleeve is pressed on to the rocker aim assembly and to provide an oil reservoir for thrust surfaces. Alternatively, the tab extends from both of the ends of the inner sleeve.

In another embodiment, the inner sleeve can have at least one tab which can extend outboard of the rocker arm assembly through a hole in a thrust surface of the outer sleeve. The tab of the inner sleeve can be, for example, D-shaped or semi-circular. Also, the inner sleeve can have a recess which opposes the tab of the inner sleeve. The hole in the outer sleeve, which can take the form of any shape, such as a predominately cylindrical shape with a wave-like upper wall, has recesses that act as stops. The tab is configured such that angular motion of the tab is limited by contact with at least one of the recesses, preventing inversion of the support pin.

In yet a further embodiment, the tab of the outer sleeve can extend inboard of the rocker arm assembly into a recess in the inner sleeve. The outer sleeve can have at least one hole for assembly purposes. The recess in the inner sleeve can be of any shape. For example, the recess can be predominately cylindrical with a convex protrusion acting as a stop. Alternatively, the recess in the inner sleeve can be elliptical. Further, the tab can be configured such that angular motion of the tab is limited by contact with the protrusion of the inner sleeve, preventing inversion of the support pin. Additionally, one of the recesses in the support pin can be larger than the other of the recesses.

In yet another embodiment, both of the recesses, which are predominately rectangular, in the support pin can be the same size. The outer sleeve can have a hole from which a tab is formed that is bent inwardly in a general axial direction and extends transversely beyond a hole in the inner sleeve and into one of the recesses of the support pin. The tab can be predominately rectangular. One of the recesses in which the tab of the outer sleeve extends can act as the stop, prevents the support pin from inverting by contact of the tab with one of the walls of the one of the recesses. Alternatively, the tabs can be formed on both sides of the outer sleeve of the rocker arm assembly.

Preferably, one of the recesses which is larger can allow for complete rotation of the support pin and one of the recesses which is smaller can act as a stop, preventing inversion of the support pin.

Preferably, the hole of the outer sleeve can be larger than the hole of the inner sleeve.

In another embodiment, the inner sleeve can have a hole from which a tab is formed that is bent outwardly in a generally axial direction and extends transversely through a hole formed in the outer sleeve. The tab can be predominately rectangular. The support pin and the inner sleeve can rotate freely in the hole of the outer sleeve over a specified range of motion. The hole in the outer sleeve can have edges which limit angular motion of the tab of the inner sleeve by contact with the edges, preventing inversion of the support pin. The hole in the outer sleeve can be predominately circular with a portion having extending inward having a concave surface and recesses at each side of the concave portion. The recesses can act as stops to prevent further rotation or inversion of the support pin. Alternatively, tabs can be formed at each side of the rocker arm, bent outwardly in a general axial direction, extending transversely through holes formed in the outer sleeve.

In yet a further embodiment, holes can be incorporated into both the inner sleeve and the outer sleeve from which a tab is formed on the inner sleeve and a tab is formed on the outer sleeve and each tab can be bent outwardly in a general axial direction in offset planes. The tab of the inner sleeve and the tab of the outer sleeve can be of any shape. For example, the tab of the inner sleeve and the tab of the outer sleeve can be predominately rectangular. The tab of the outer sleeve acts as a stop for the tab of the inner sleeve, preventing inversion of the support pin. The tab of the inner sleeve and the tab of the outer sleeve are configured such that the support pin and the inner sleeve can rotate freely in the hole of the outer sleeve over a specified range of angular motion, relative to the tab of the outer sleeve. The support pin and the inner sleeve are limited by contact of the tab of the inner sleeve with the tab of the outer sleeve, which prevents inversion of the support pin. The hole in the outer sleeve is predominately circular with a linear portion where the tab extends. The hole in the outer sleeve is larger than the hole in the inner sleeve. Alternatively, both the inner sleeve and the outer sleeves can have a tab formed at each side of the rocker arm, bent outwardly in a general axial direction.

Preferably, a retention flange can be formed on the inner sleeve to retain the rolling bodies.

Preferably, a retention flange can be formed on the outer sleeve to retain the rolling bodies.

Preferably, retention flanges can be formed on the inner sleeve and the outer sleeve to retain the rolling bodies.

Preferably, a thrust surface of the inner sleeve, a thrust surface of the outer sleeve, and a thrust surface of the end of the support pin can have etchings.

Preferably, either a thrust surface of the outer sleeve or a thrust surface of the inner sleeve can be flat, contoured, crowned/domed, or include geometries promoting oiling and alleviating edge loading.

Preferably, a thrust surface of the outer sleeve can act directly on the end of the support pin.

Preferably, coatings can be applied to the thrust surface of the inner sleeve, outer sleeve, and support pin. The coatings include various phosphates, Teflon®, and diamond-like coatings known as C+ and C++.

Preferably, a low friction washer made of Torlon®, Teflon®, graphite Oilite® can be incorporated between the thrust surface of the inner sleeve, the outer sleeve, and the support pin.

BRIEF DESCRIPTION OF THE DRAWINGS

The present invention will be further understood and appreciated by reading the following description in conjunction with the accompanying drawings, in which.

DETAILED DESCRIPTION OF THE DRAWINGS

Figure 1:
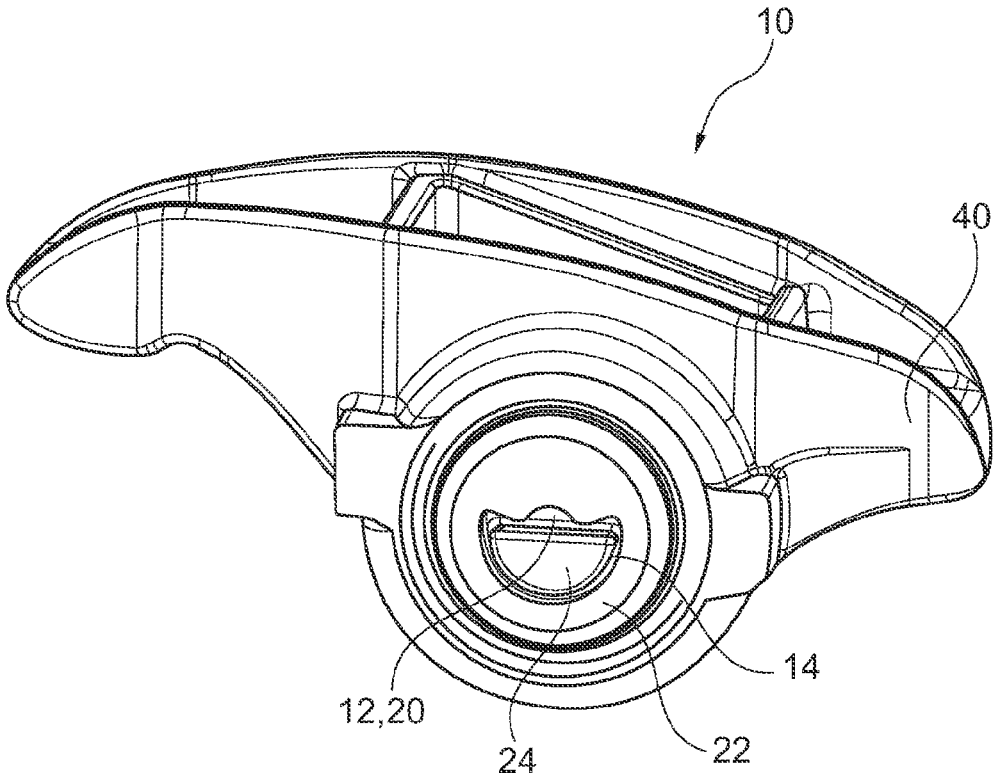
FIG. 1 is a perspective view of the rocker arm assembly with an axially extending anti-inversion feature incorporated into the support pin, protruding through an inner sleeve and an outer sleeve.

FIG. 1 illustrates a perspective view of the rocker arm assembly 10 with a hole 12, 14 in a thrust surface 16, 18 of the inner sleeve 20 and the outer sleeve 22, respectively, through which a tab 24 of a support pin 26 projects. The tab 24 can be incorporated onto one end or both ends 28, 30 of the support pin 26. As shown, the tab 24 of the support pin 26 has a predominately D-shape. The hole 14 in the outer sleeve 22 has concave bottom portion and a wavelike upper portion with recesses at each end of the upper portion that act as stops for tab(s) 24 of the support pin 26, preventing the support pin 26 from inverting. However, the shape of the tab 24 and the hole 14 of the outer sleeve 22 can be of any desirable shape.

Figure 2:
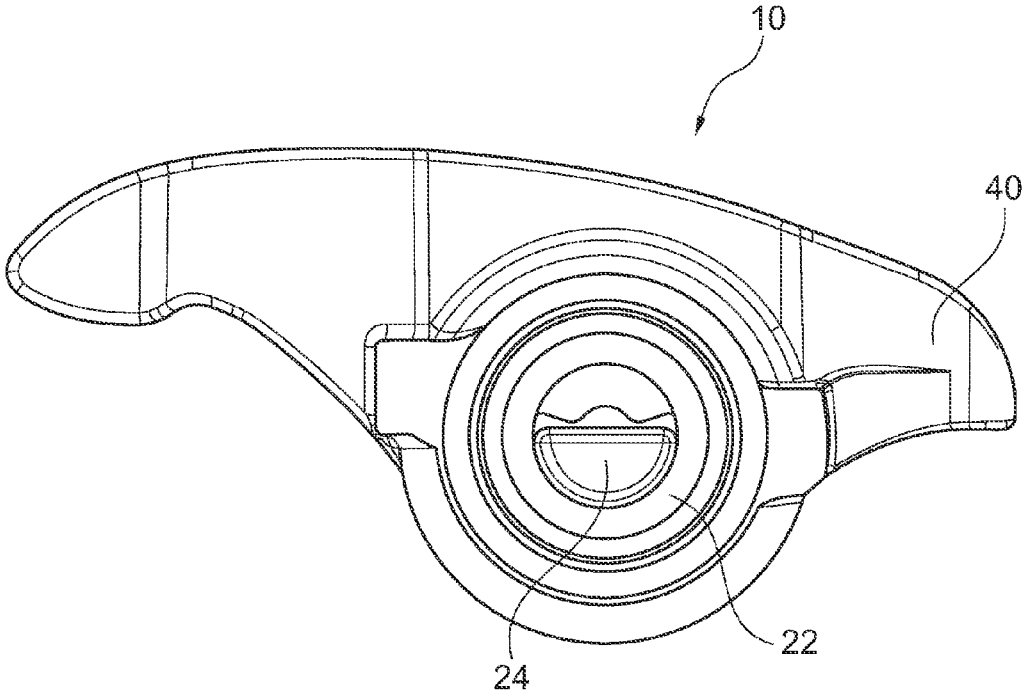
FIG. 2 is a side view of the rocker aim assembly of FIG. 1.

FIG. 2 illustrates a side view of the rocker arm assembly 10 with the tab 24 extending axially from an end 28 or 30 of the support pin 26.

Figure 3:
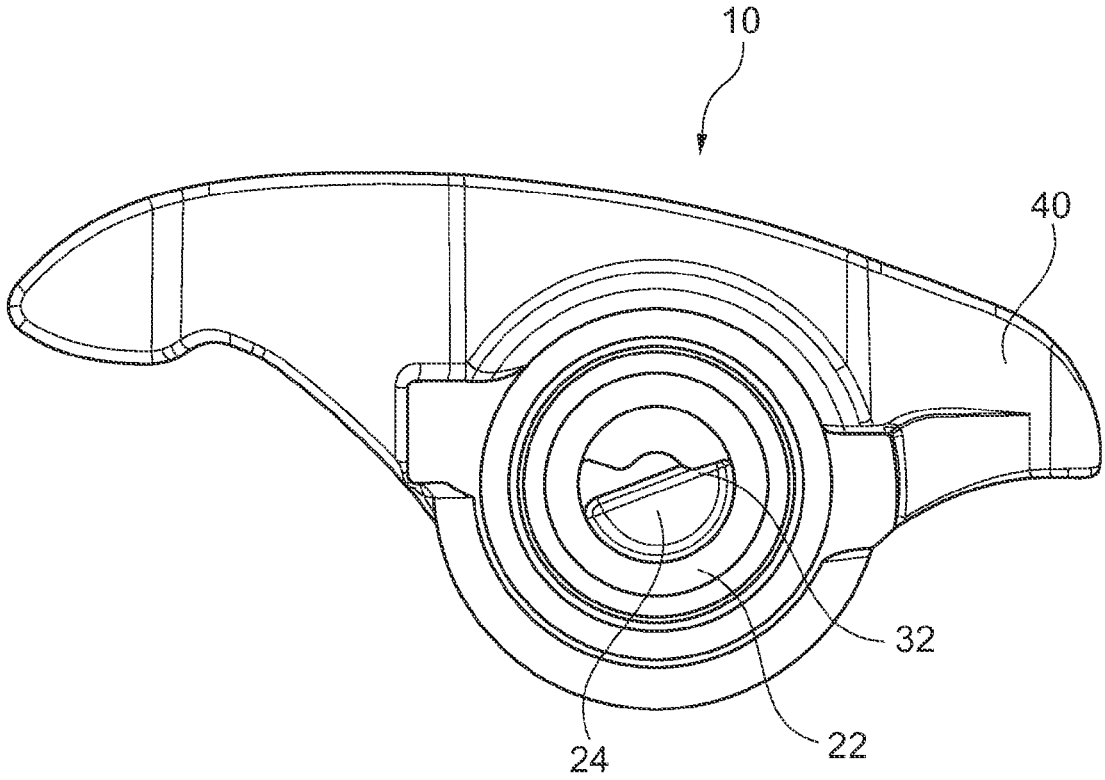
FIG. 3 is a side view of the rocker arm assembly of FIG. 1 with the support pin contacting the outer sleeve.

FIG. 3 illustrates a side view of the rocker arm assembly 10 with the tab 24 contacting one of the walls 32 of the hole 14 formed in the outer sleeve 22, which prevents the support pin 26 from inverting.

Figure 4:
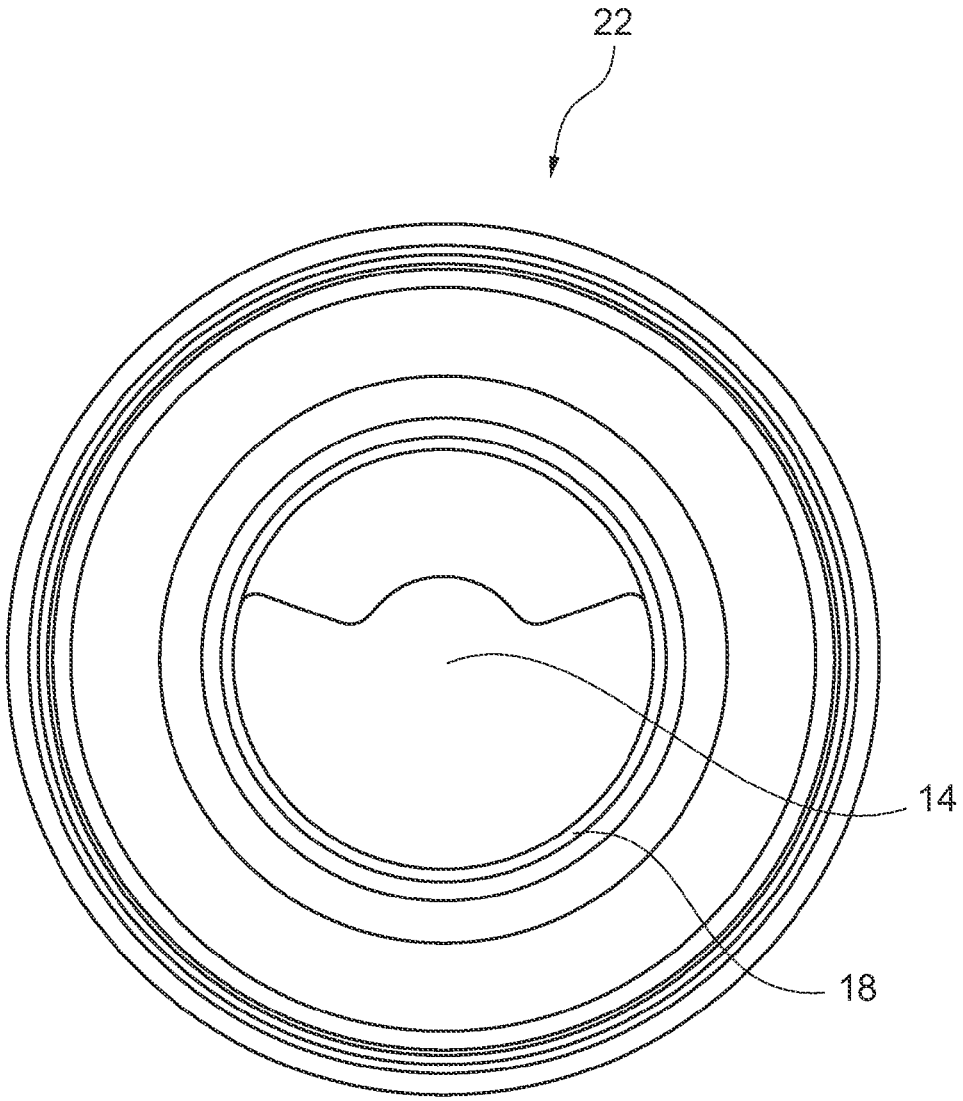
FIG. 4 is a side view of the outer sleeve of the rocker arm assembly of FIG. 1.

FIG. 4 illustrates the outer sleeve 22 with the hole 14 formed on the thrust surface 18 of the outer sleeve 22.

Figure 5:
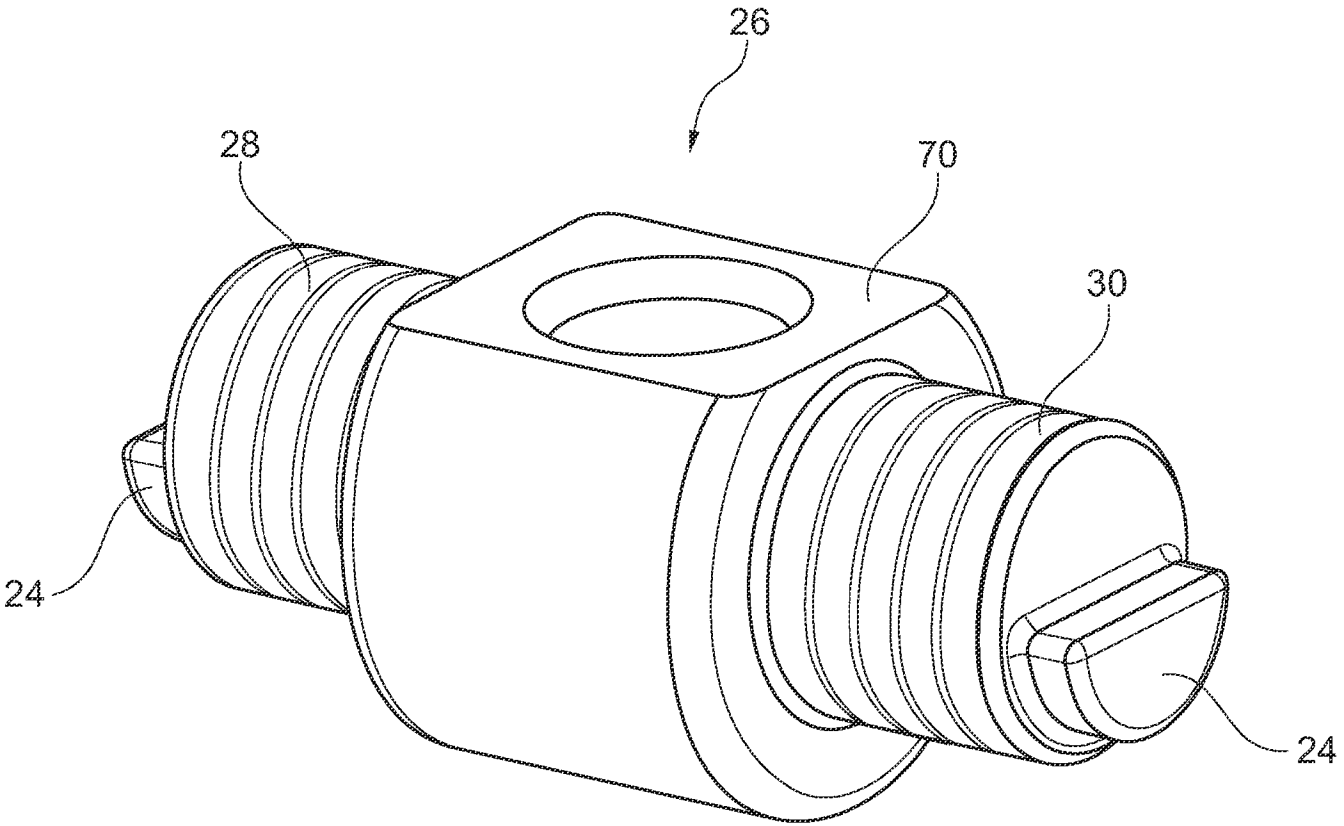
FIG. 5 is a perspective view of a support pin of the rocker arm assembly of FIG. 1.

FIG. 5 illustrates the support pin 26 with the tabs 24. The support pin 26 has a central section 70 and the two cylindrical ends 28, 30. The central section 70 is predominately cylindrical with a substantially flat upper surface. The ends 28, 30, which are located on each side of the central section 70, are stepped and narrower in diameter than the central section 70. The tabs 24 extend from the ends 28, 30. As shown, the tabs 24 are positioned near the bottom half of the cylindrical ends 28, 30. However, the tabs 24 can be positioned anywhere on the cylindrical ends 28, 30.

Figure 6:
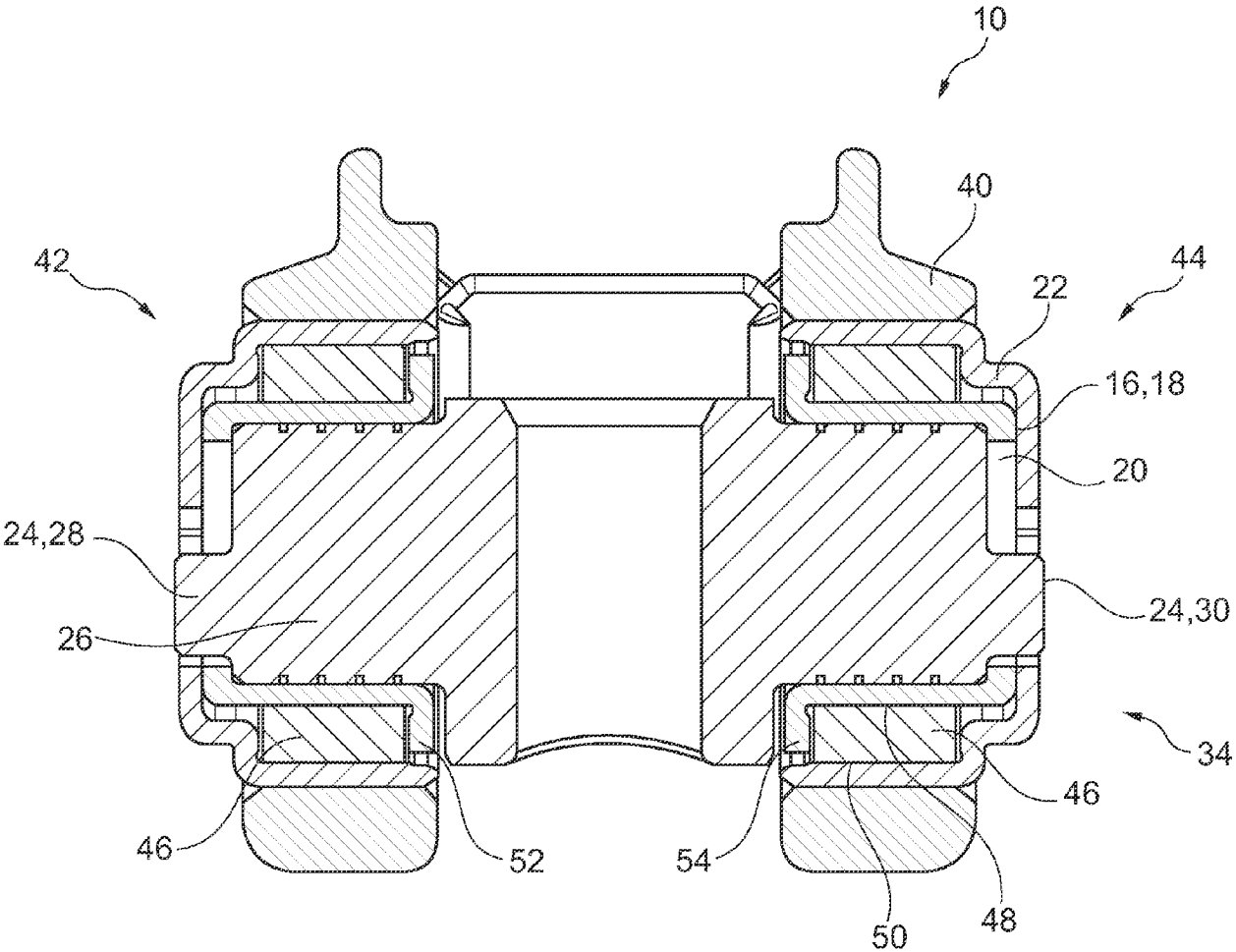
FIG. 6 is a transverse cross-sectional view of the rocker arm assembly of FIG. 1.

FIG. 6 illustrates a transverse cross-sectional view of the rocker arm assembly 10 with the tabs 24 of the support pin 26 extending outward, away from the axis of rotation of the rocker arm assembly 10. As shown, a through-hole 34 passes through sidewalls of the rocker arm 40. The support pin 26, which is fixed to the inner sleeve 20, is positioned in the through-hole 34 and allows the rocker arm 40 to rotate. A bearing 42, 44 is positioned at each axial side of the support pin 26. Each bearing 42, 44 includes an inner sleeve 20, an outer sleeve 22, which is fixed to the rocker arm 40, and rolling elements 46 positioned on raceways 48, 50 formed between the inner sleeve 20 and the outer sleeve 22. The rolling elements 46 are illustrated as generally cylindrical, however, needle rollers or spherical rollers can be employed.

Figure 7:
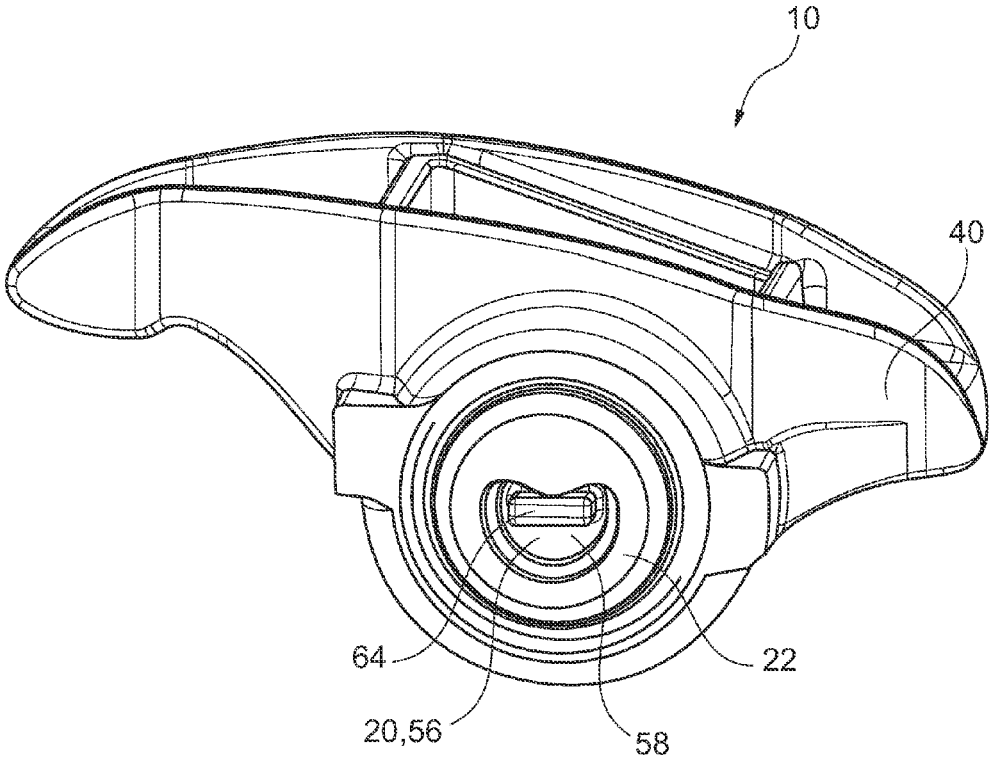
FIG. 7 is a perspective view of the rocker arm assembly with an axially extending anti-inversion feature incorporated into the support pin, protruding through an inner sleeve and an outer sleeve.

FIG. 7 illustrates a perspective view of the rocker arm assembly 10 with a hole 56, 58 in a thrust surface 60, 62 of the inner sleeve 20 and the outer sleeve 22, respectively, through which a tab 64 of the support pin 26 projects. The tab 64 can be incorporated onto one or both ends 28, 30 of the support pin 26. As shown, the tab 64 is predominately rectangular. The hole 58 in the outer sleeve 22 has concave bottom portion and a concave upper portion acts as a stop for the tab 64 of the support pin 26, preventing the support pin 26 from inverting.

While the tabs 24, 64 are shown as generally D-shaped or rectangular, respectively, any suitable combination of geometries may be used. Similarly, any suitable combination of geometries can be used for the holes 12, 14, 56, 58 formed in the inner sleeve 20 and the outer sleeve 22 as well.

Figure 8:
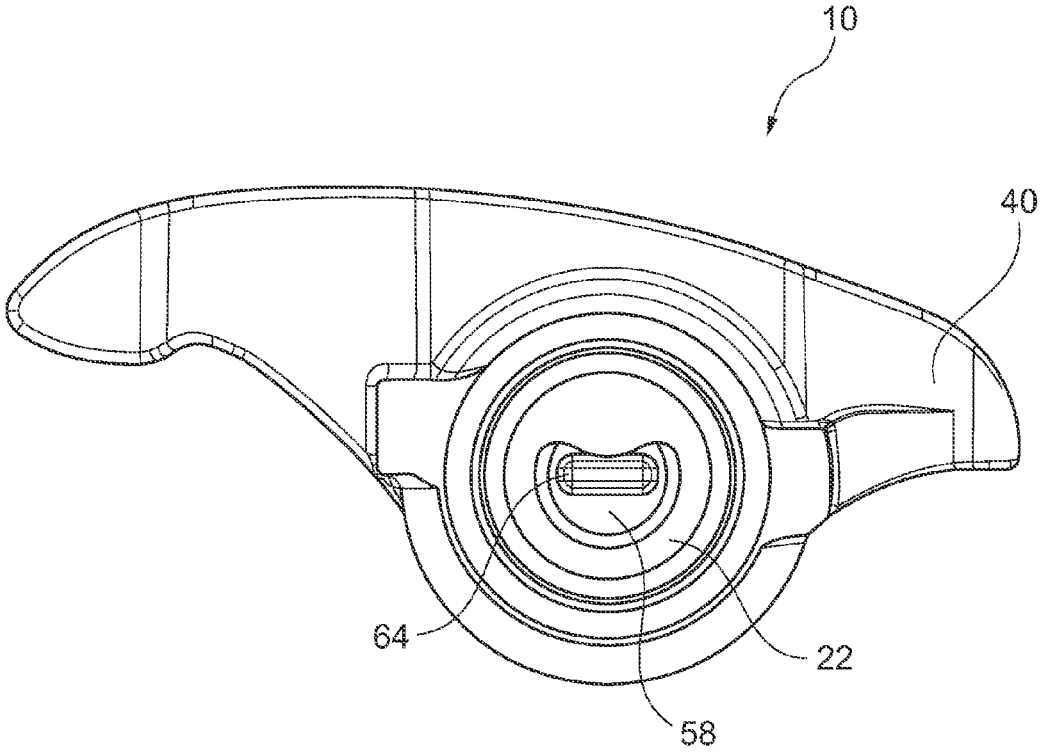
FIG. 8 is a side view of the rocker arm assembly of FIG. 7.

FIG. 8 illustrates a side view of the rocker arm assembly 10 with the tab 64 extending axially from an end 28 or 30 of the support pin 26.

Figure 9:
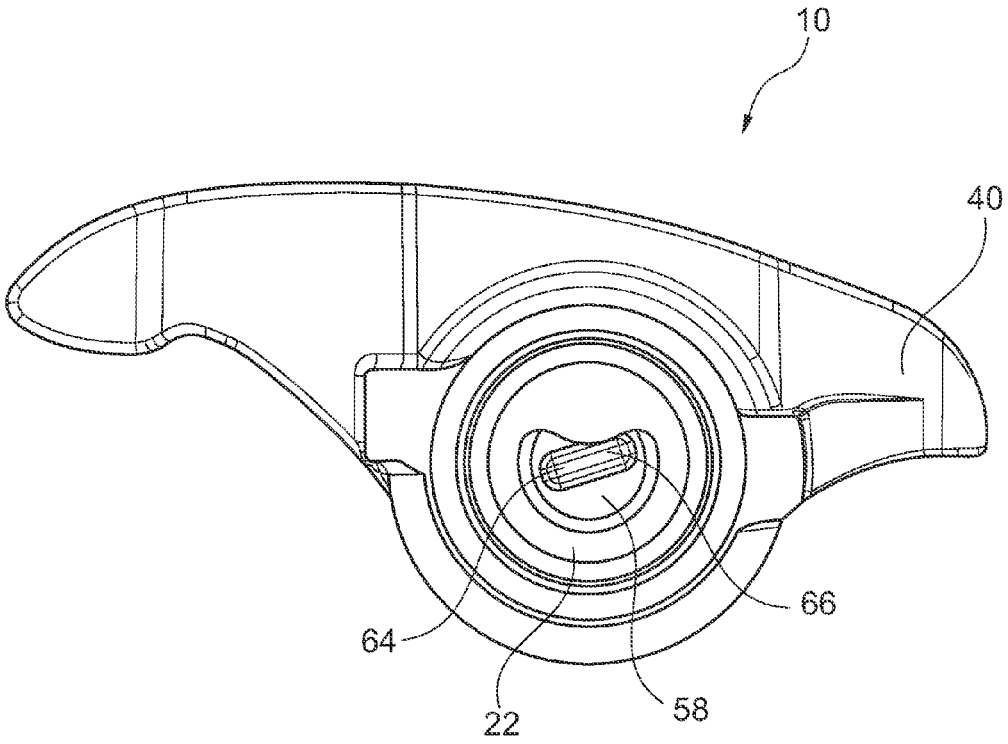
FIG. 9 is a side view of the rocker arm assembly of FIG. 7 with the support pin contacting the outer sleeve.

FIG. 9 illustrates a side view of the rocker arm assembly 10 with the tab 64 contacting one of the walls 66 of the hole 58 formed in the outer sleeve 22, which prevents the support pin 26 from inverting.

Figure 10:
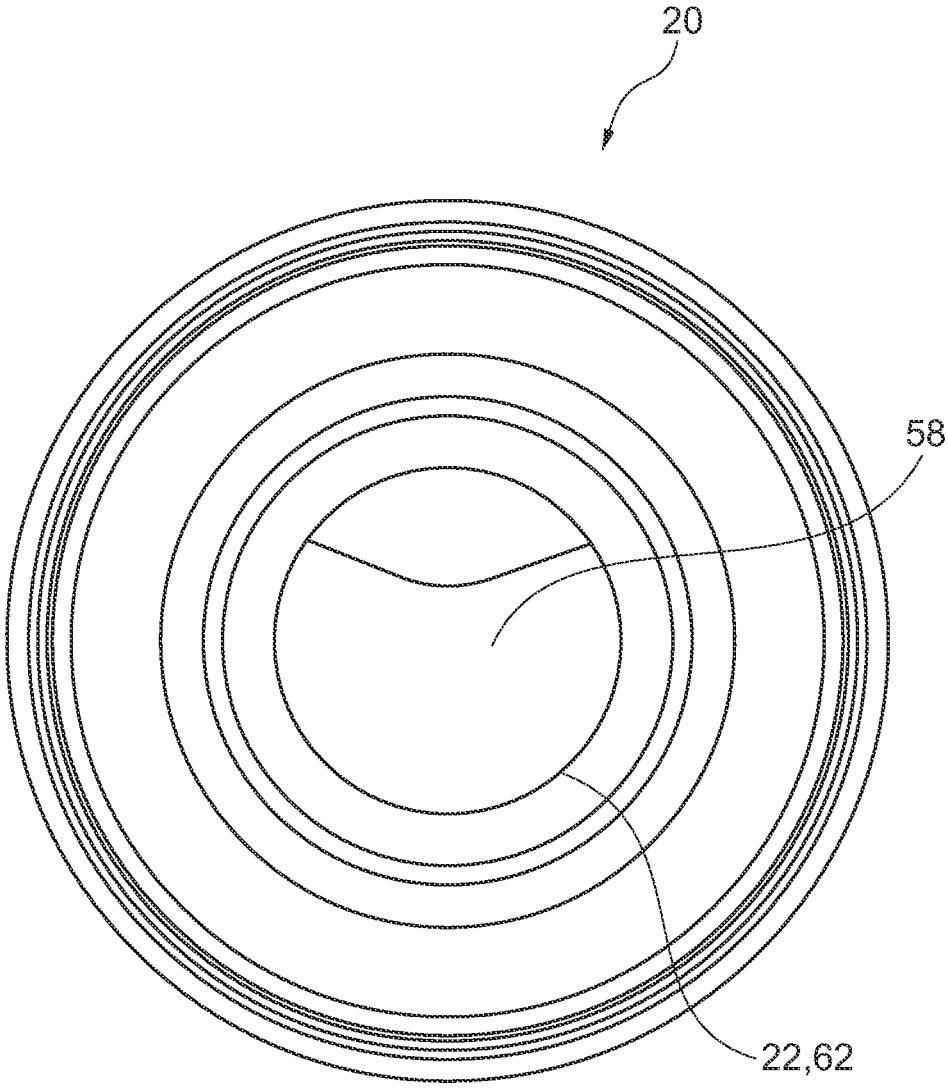
FIG. 10 is a side view of the outer sleeve of the rocker arm assembly of FIG. 7.

FIG. 10 illustrates an inside view of the inner sleeve 20 and the outer sleeve 22. The hole 58 can be formed in the thrust surface 62 of the outer sleeve 22.

Figure 11:
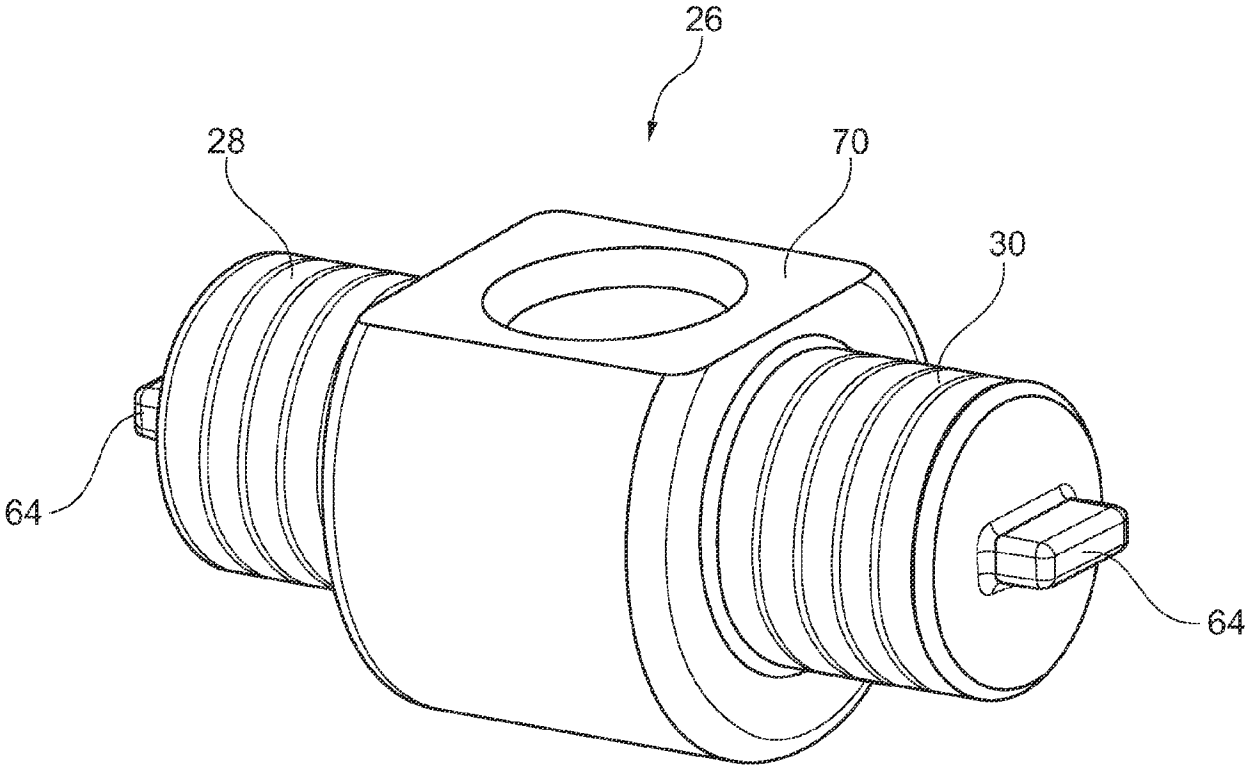
FIG. 11 is a perspective view of a support pin of the rocker arm assembly of FIG. 7.

FIG. 11 illustrates the support pin 26 with the tabs 64. The support pin 26 has a central section 70 and the two cylindrical ends 28, 30. The central section 70 is predominately cylindrical with a substantially flat upper surface. The ends 28, 30, which are located on each side of the central section 70, are stepped and narrower in diameter than the central section 70. The tabs 64 extend from the ends 28, 30. As shown, the tabs 64 are centrally positioned on the ends 28, 30. However, the tabs 64 can be positioned anywhere on the cylindrical ends 28, 30.

Figure 12:
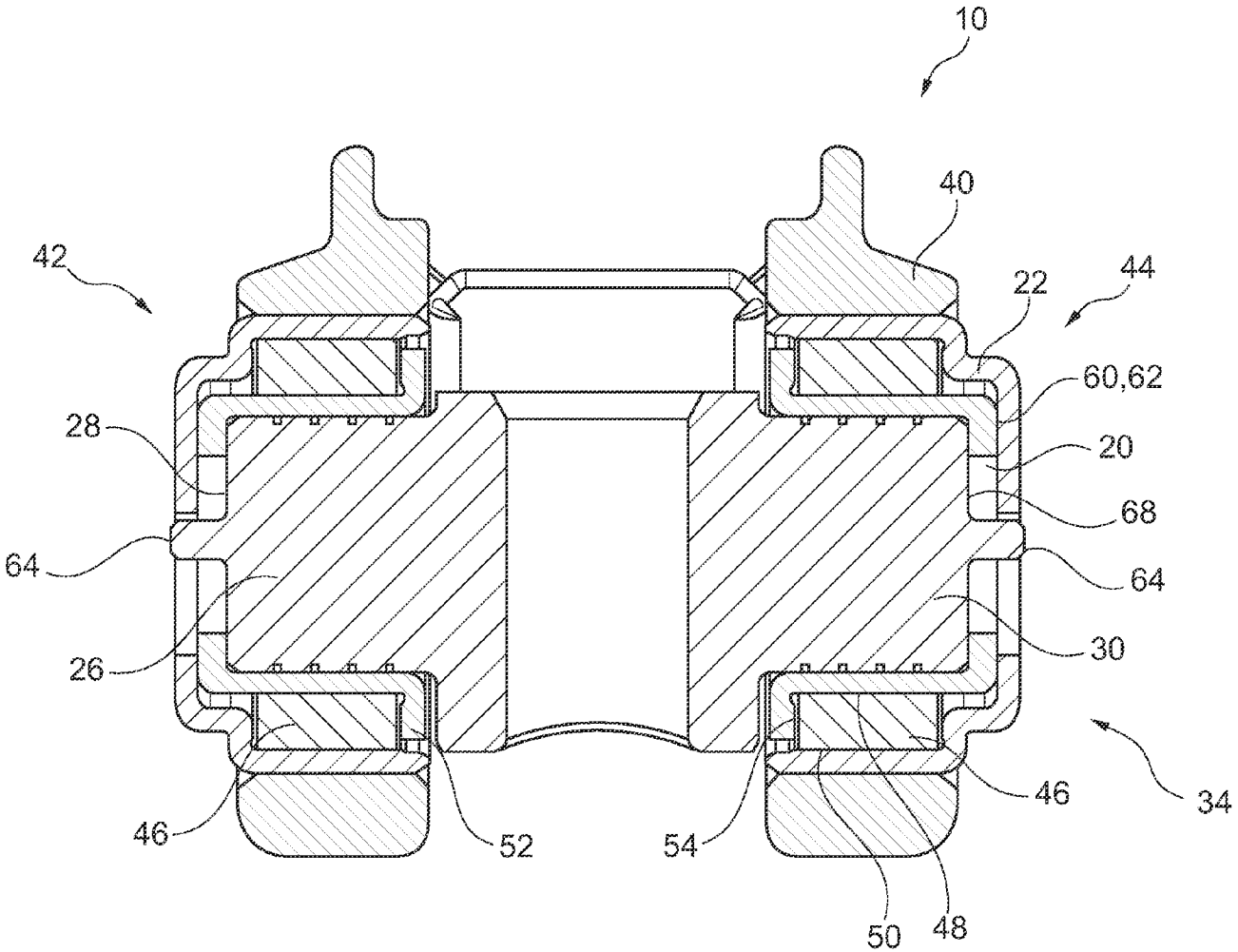
FIG. 12 is a transverse cross-sectional view of the rocker arm assembly of FIG. 7.

FIG. 12 illustrates a transverse cross-sectional view of the rocker arm assembly 10 with the tabs 64 of the support pin 26 extending outward. As shown, the through-hole 34 passes through sidewalls of the rocker arm 40. The support pin 26, which is fixed to the inner sleeve 20, is positioned in the through-hole 34 and allows the rocker arm 40 to rotate. The bearing 42, 44 is positioned at each axial side of the support pin 26. Each bearing 42, 44 includes the inner sleeve 20, the outer sleeve 22, which is fixed to the rocker arm 40, and rolling elements 46 positioned on the raceways 48, 50 formed between an inner sleeve 20 and an outer sleeve 22. The rolling elements 46 are illustrated as generally cylindrical, however, needle rollers or spherical rollers can be employed.

Figure 13:
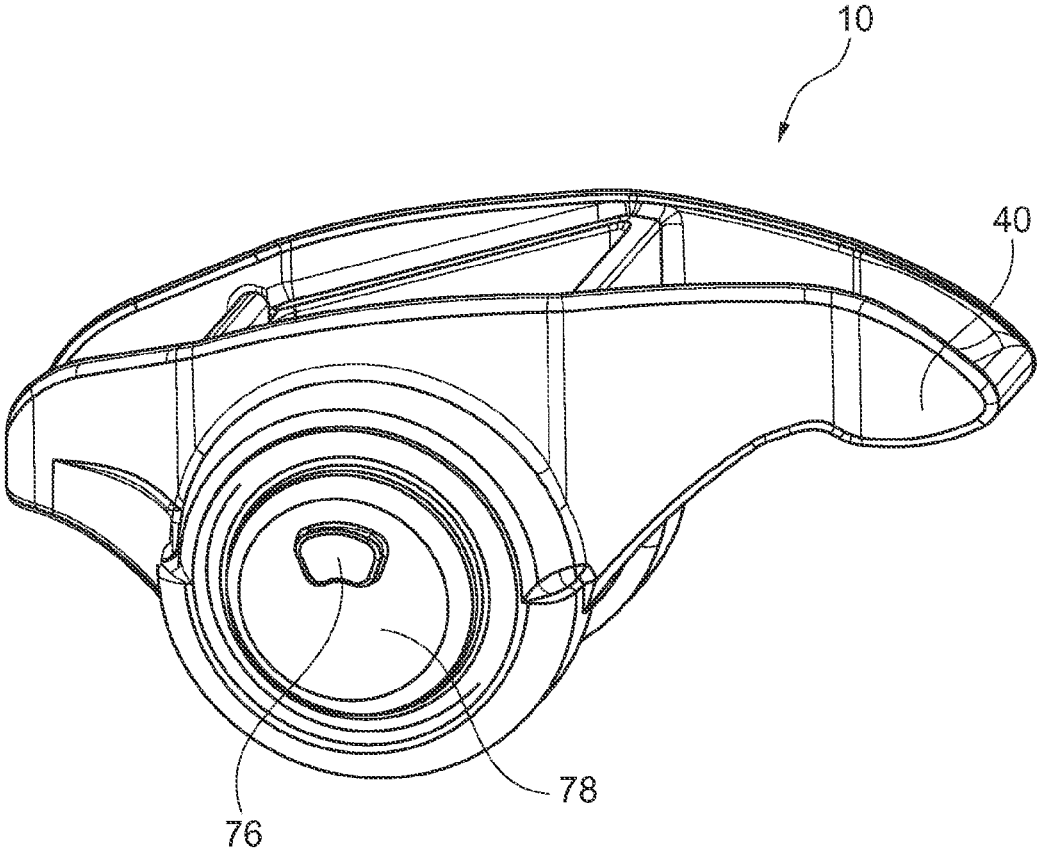
FIG. 13 is a perspective view of the rocker arm assembly with an axially extending anti-inversion feature incorporated into the inner sleeve, protruding into a recess formed in the outer sleeve.

FIG. 13 illustrates a perspective view of the rocker arm assembly 10 with an inner sleeve 72 having a tab 74 that projects axially outboard and rests in a recess 76 formed in a bulge of an outer sleeve 78. The tab 74 can be incorporated onto one or both sides of the inner sleeve 72. As shown, the tab 74 is a predominately circular. However, the tab 74 can be of any desirable shape. The interaction of shapes of the recess 74 on the outer sleeve 78 and the tab 74 on the inner sleeve 72 allow for sufficient clearance to avoid impeding the articulation of the rocker arm 40 during the valve event, while keeping the support pin 26 from completely inverting. Any suitable combination of inner sleeve 72 and outer sleeve 78 geometries can be used.

Figure 14:
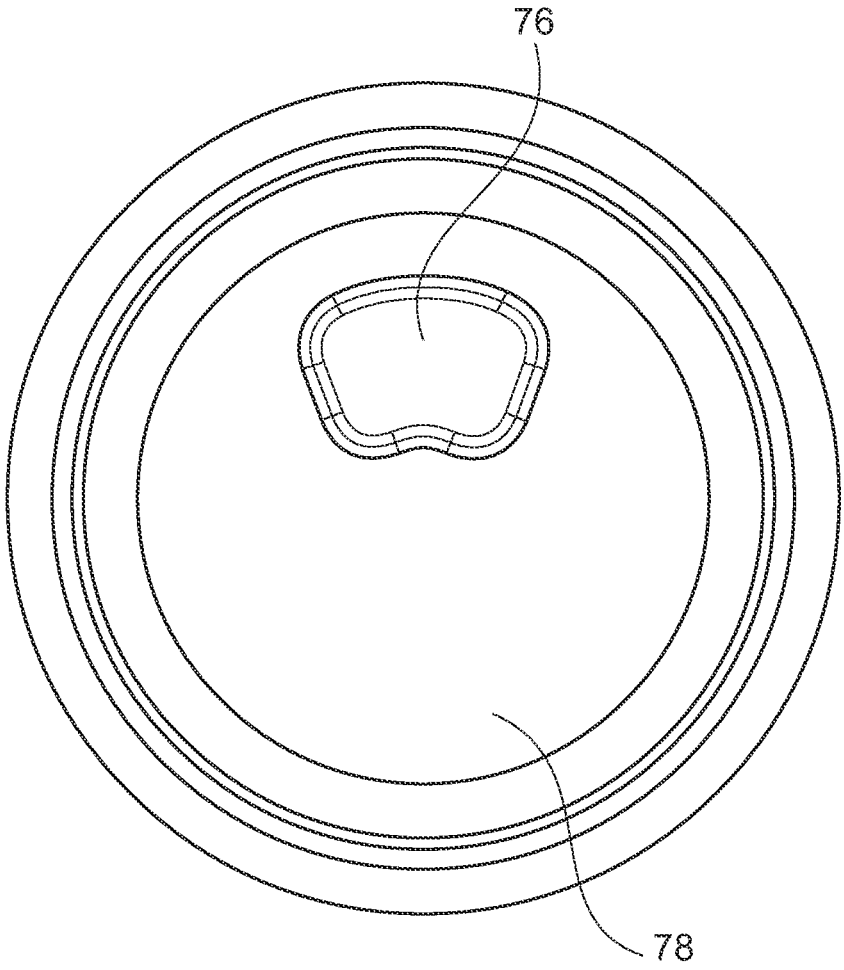
FIG. 14 is a side view of the outer sleeve of the rocker arm assembly of FIG. 13.

FIG. 14 illustrates a side view of the outer sleeve 78 with the recess 76, which protrudes in an outward direction.

Figure 15:
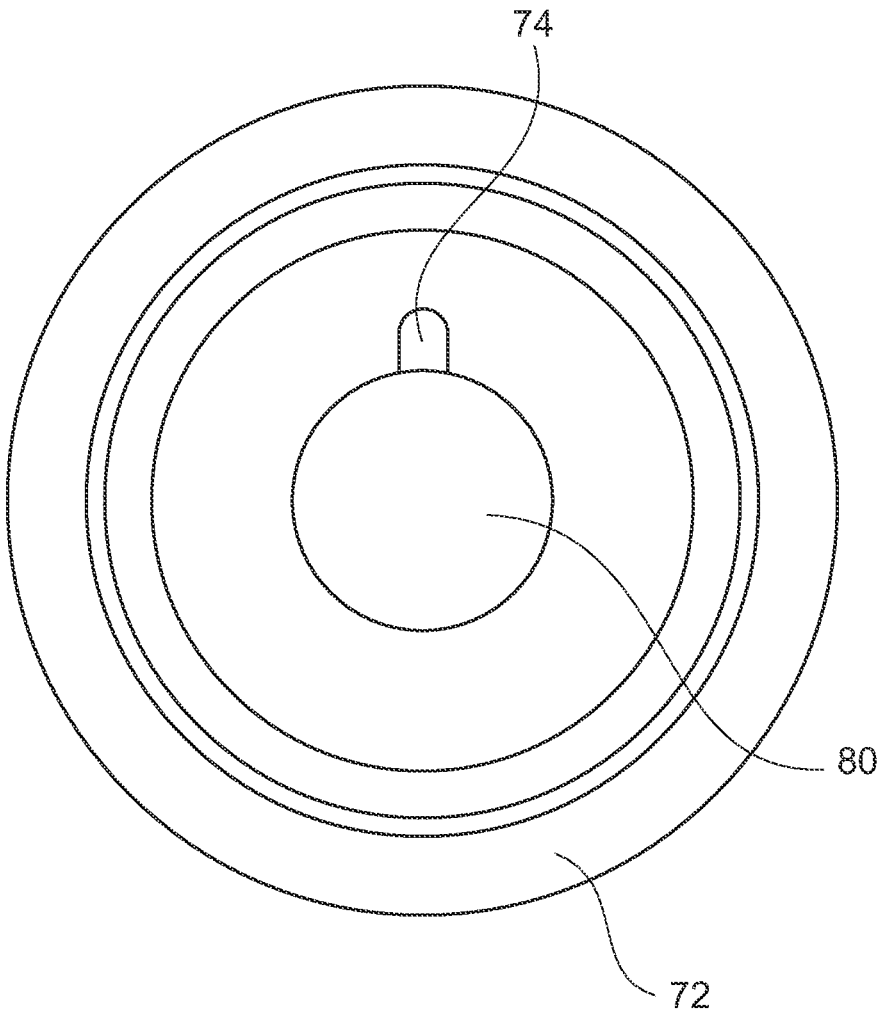
FIG. 15 is a side view of the inner sleeve of the rocker arm assembly of FIG. 13.

FIG. 15 illustrates a side view of the inner sleeve 72 with the tab 74, which protrudes in an outward direction, into the recess 76 of the outer sleeve 78. Also, a through hole 80 is incorporated into the outboard side of the inner sleeve 72 to prevent air from being trapped when the inner sleeve 72 is pressed on to the rocker arm assembly 10 and to provide an oil reservoir for the thrust surfaces.

Figure 16:
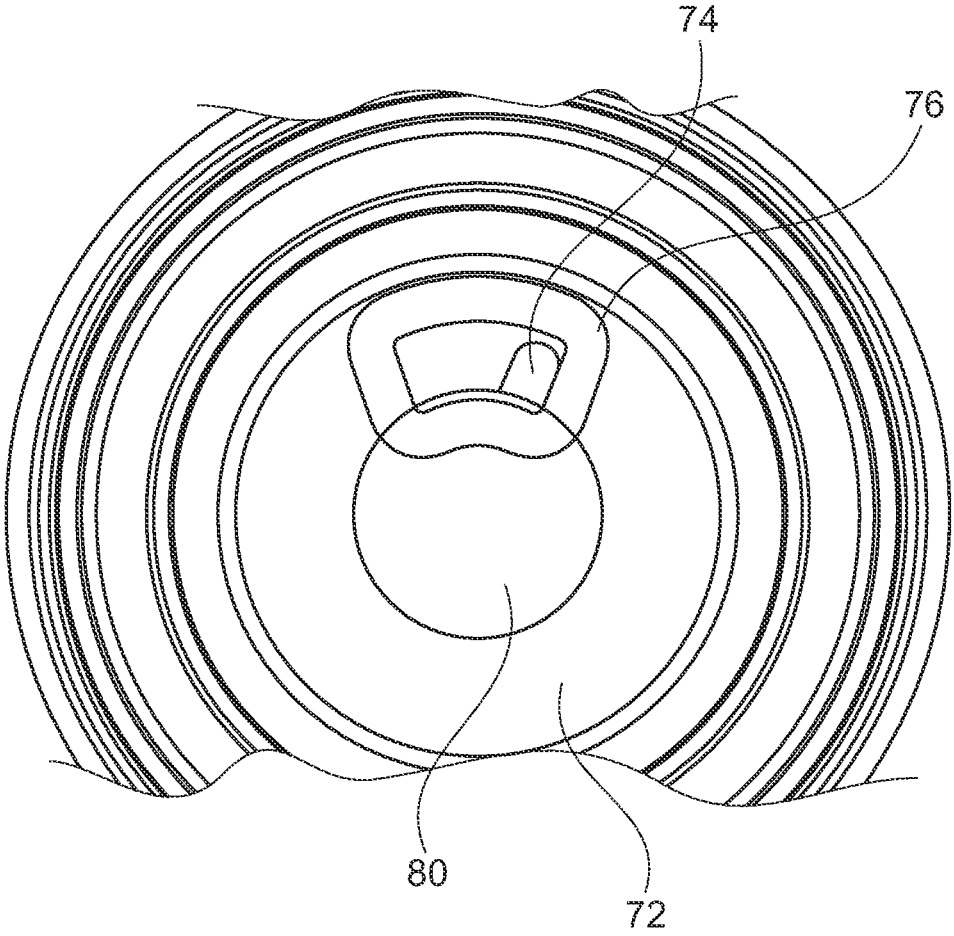
FIG. 16 is a side view of the interaction of the inner sleeve and outer sleeve of the rocker arm assembly of FIG. 13.

FIG. 16 illustrates a side view of the interaction of the inner sleeve 72 with the tab 74 and the recess 76 of the outer sleeve 78.

Figure 17:
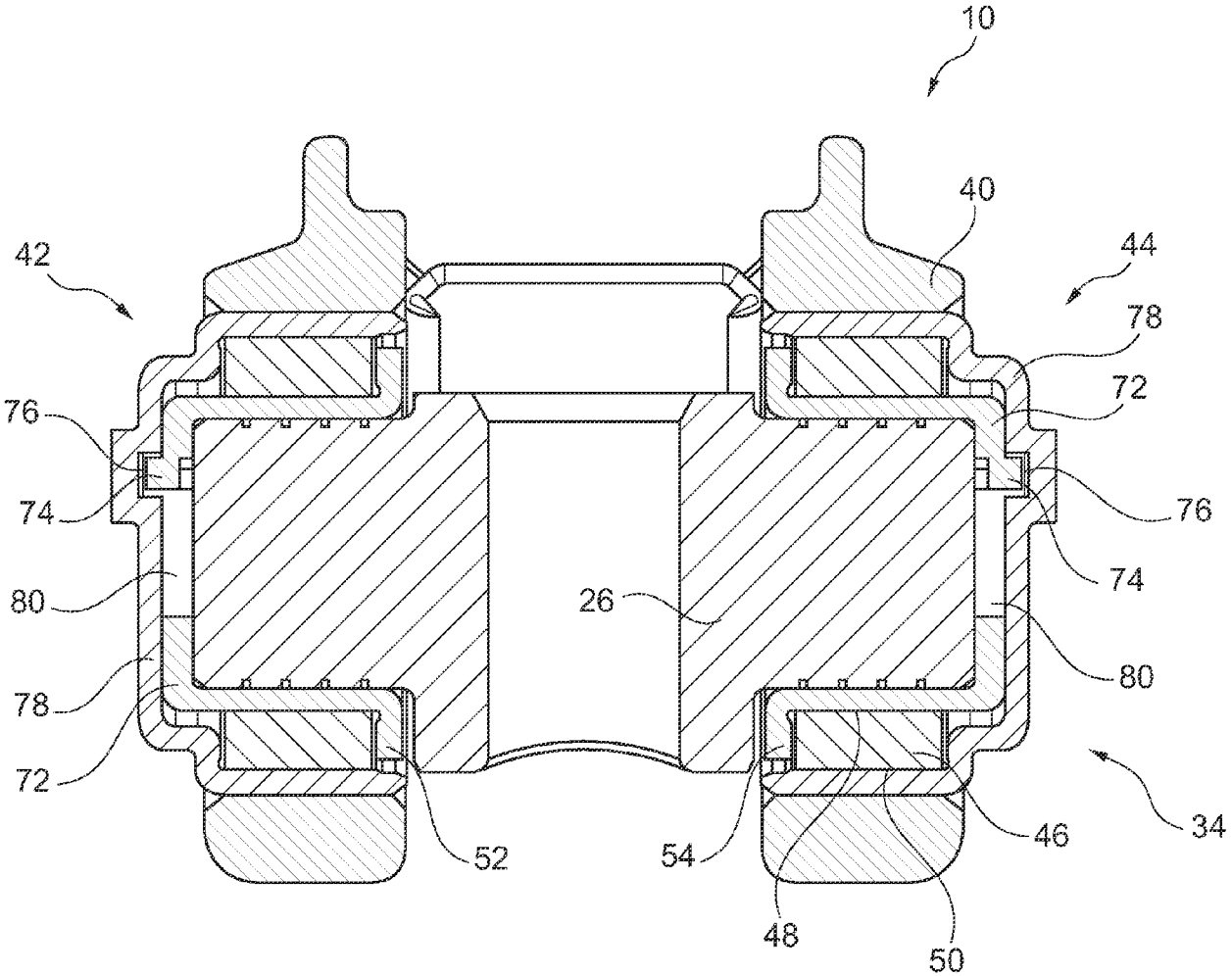
FIG. 17 is a transverse cross-sectional view of the rocker arm assembly of FIG. 13.

FIG. 17 illustrates a transverse cross-sectional view of the rocker arm assembly 10 with the tab 74 of the inner sleeve 72 extending outward into the recess 76 of the outer sleeve 78. As shown, a through-hole 34 passes through sidewalls in the rocker arm 40. The support pin 26, which is fixed to the inner sleeve 72, is positioned in the through-hole 34 and allows the rocker arm 40 to rotate. A bearing 42, 44 is positioned at each axial side of the support pin 26. Each bearing 42, 44 includes the inner sleeve 72, the outer sleeve 78, which is fixed to the rocker arm 40, and rolling elements 46 positioned on raceways 48, 50 formed between the inner sleeve 72 and the outer sleeve 78. The rolling elements 46 are illustrated as generally cylindrical, however, needle rollers or spherical rollers can be employed.

Figure 18:
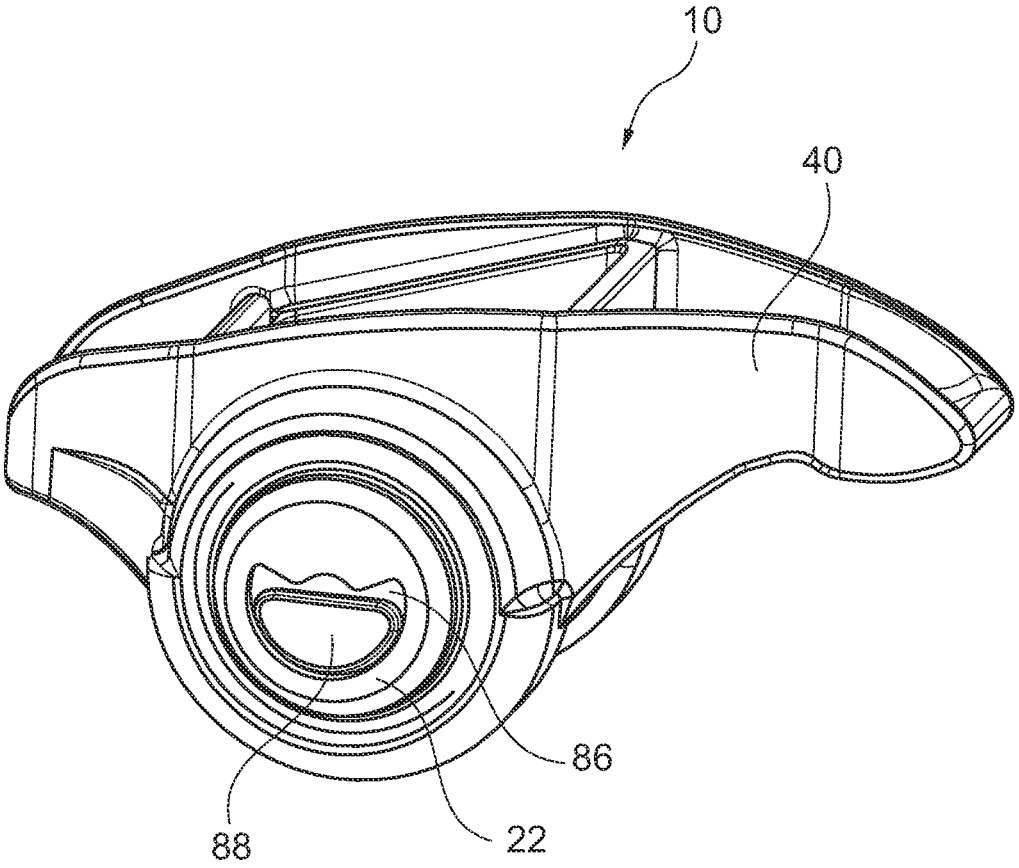
FIG. 18 is a perspective view of the rocker arm assembly with an axially extending anti-inversion feature incorporated onto the inner sleeve, protruding through a hole formed in the outer sleeve.

FIG. 18 illustrates a perspective view of the rocker arm assembly 10 with an inner sleeve 86 that has a tab 88 that projects axially outboard through the hole 14 formed in the outer sleeve 22. As shown, the tab 88 of the inner sleeve 86 has a predominately semi-circular, or D-shape. The hole 14 in the outer sleeve 22 has concave bottom portion and a wavelike upper portion with recesses at each end of the upper portion that act as stops for tab 88 of the inner sleeve 86, preventing the support pin 26 from inverting. However, the tab 88 and the hole 14 of the outer sleeve 22 can be of any desirable shape.

Figure 19:
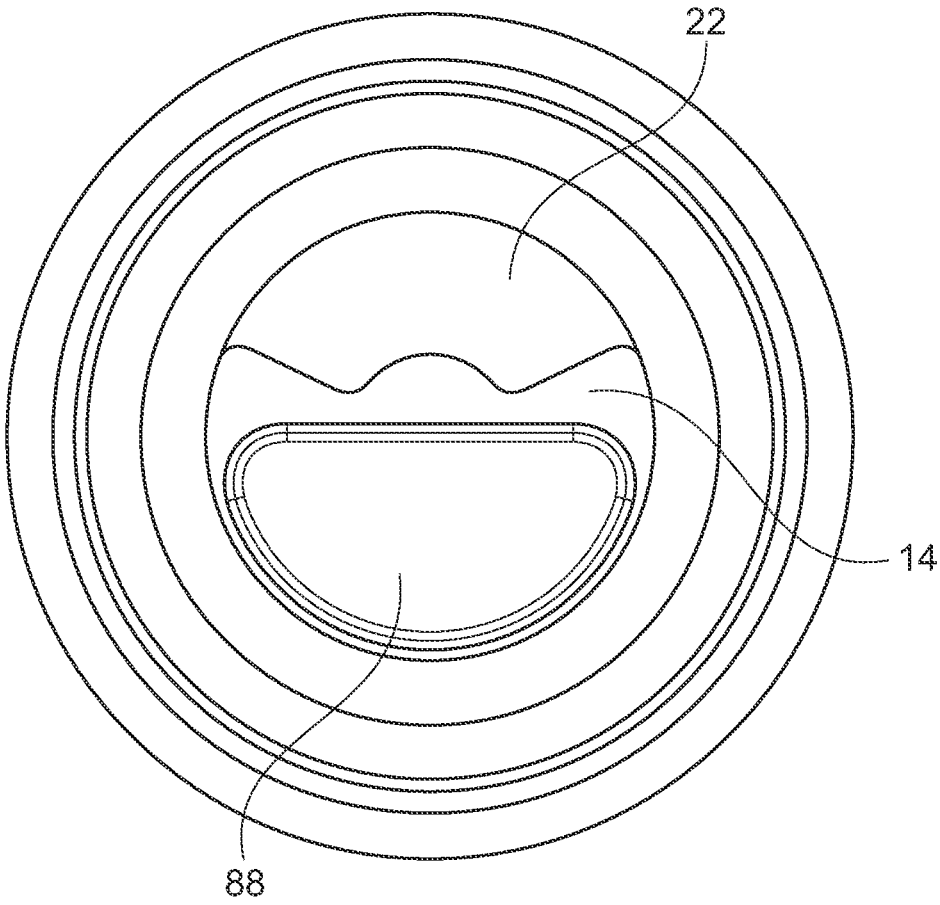
FIG. 19 is a side view of the outer sleeve of the rocker arm assembly of FIG. 18.

FIG. 19 illustrates a side view of the outer sleeve 22 with the hole 14 formed on the thrust surface 18 of the outer sleeve 22.

Figure 20:
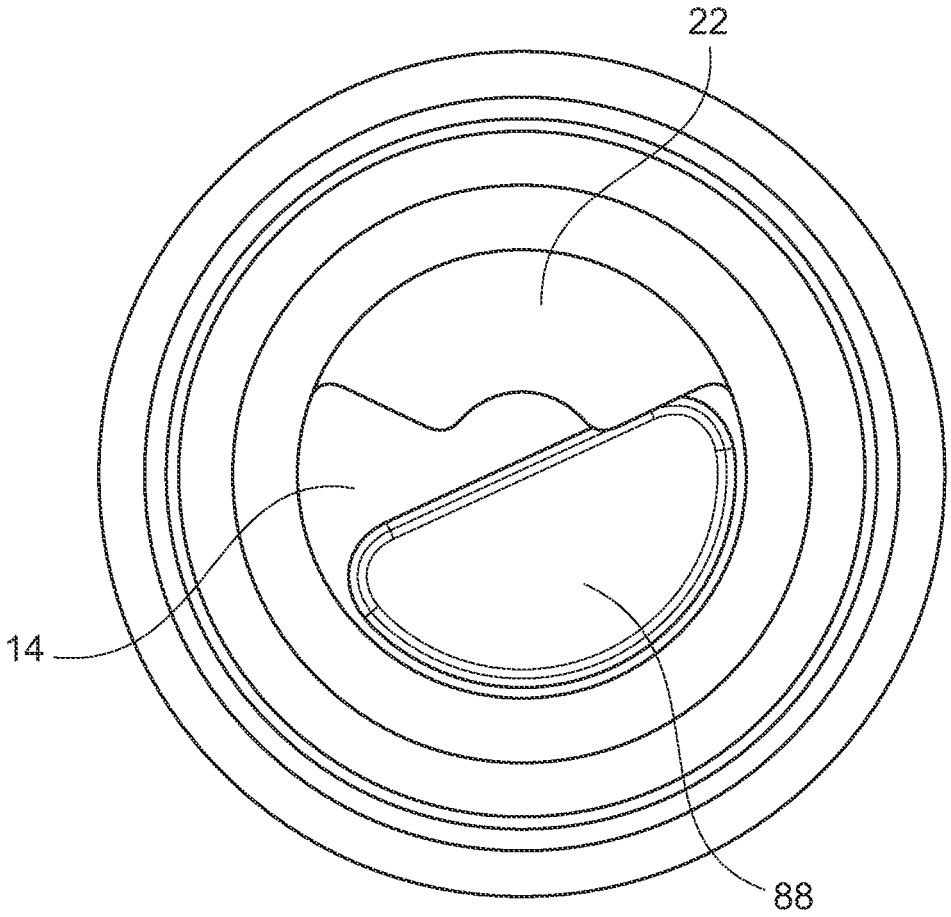
FIG. 20 is a side view of the outer sleeve of the rocker arm assembly of FIG. 18 with the inner sleeve contacting the outer sleeve.

FIG. 20 illustrates a side view of the rocker arm assembly 10 with the tab 88 contacting one of the recesses formed in the outer sleeve 22, which prevents the support pin 26 from inverting.

Figure 21:
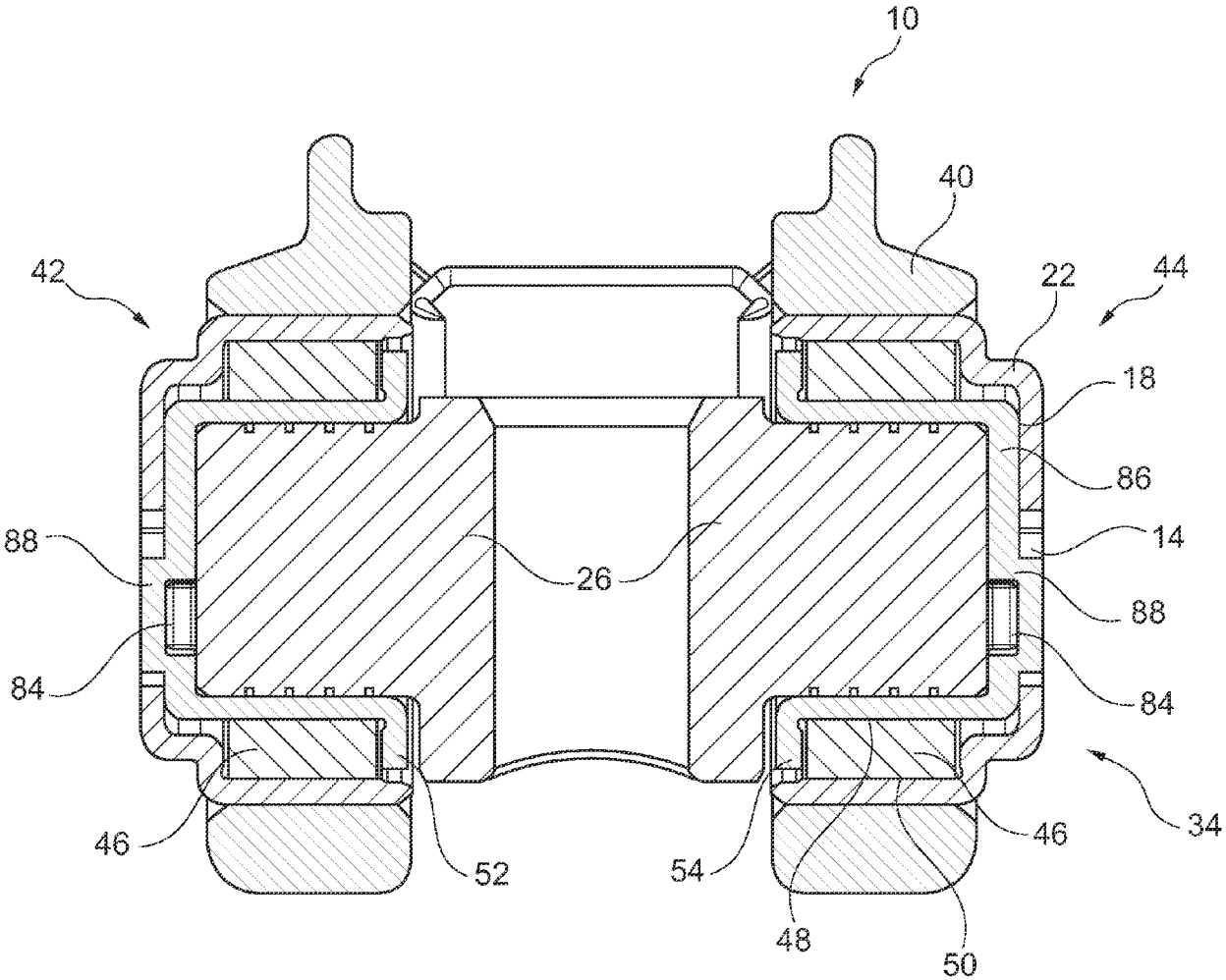
FIG. 21 is a transverse cross-sectional view of the rocker arm assembly of FIG. 18.

FIG. 21 illustrates a transverse cross-sectional view of the rocker aim assembly 10 with the tab 88 of the inner sleeve 86 extending outward through the hole 14 in the outer sleeve 22. Moreover, a through-hole 34 passes through sidewalls of the rocker arm 40. The support pin 26, which is fixed to the inner sleeve 86, is positioned in the through-hole 34 and allows the rocker arm 40 to rotate. A bearing 42, 44 is positioned at each axial side of the support pin 26. Each bearing 42, 44 includes the inner sleeve 86, the outer sleeve 22, which is fixed to the rocker arm 40, and rolling elements 46 positioned on raceways 48, 50 formed between the inner sleeve 86 and the outer sleeve 22. The rolling elements 46 are illustrated as generally cylindrical, however, needle rollers or spherical rollers can be employed.

Figure 22:
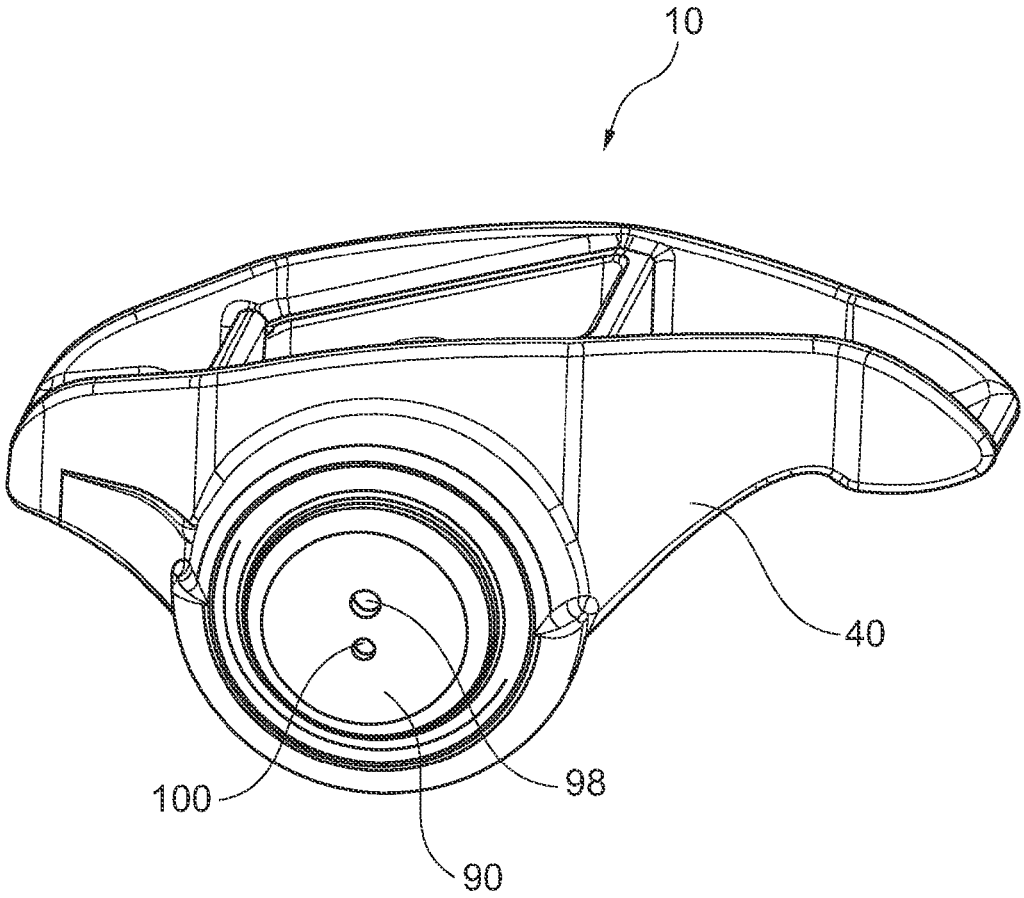
FIG. 22 is a perspective view of the rocker arm assembly with an axially extending anti-inversion feature incorporated onto the outer sleeve, extending into a recess formed in the inner sleeve.

FIG. 22 illustrates a perspective view of the rocker arm assembly 10 with the outer sleeve 90 which has a tab 92 that projects axially inboard and rests in a recess 94 formed in the inner sleeve 96. The tab 92 can be incorporated onto one or both of the outer sleeves 90. As shown, the tab 92 is predominately circular. However, the tab 92 can be of any desirable shape. The interaction of shapes of the recess 94 on the inner sleeve 96 and the tab 92 on the outer sleeve 90 allows for sufficient clearance to avoid impeding the articulation of the rocker arm 40 during the valve event, while keeping the support pin 26 from completely inverting. Also, a recess 100 is formed opposite the tab 92 of the outer sleeve 90.

Figure 23:
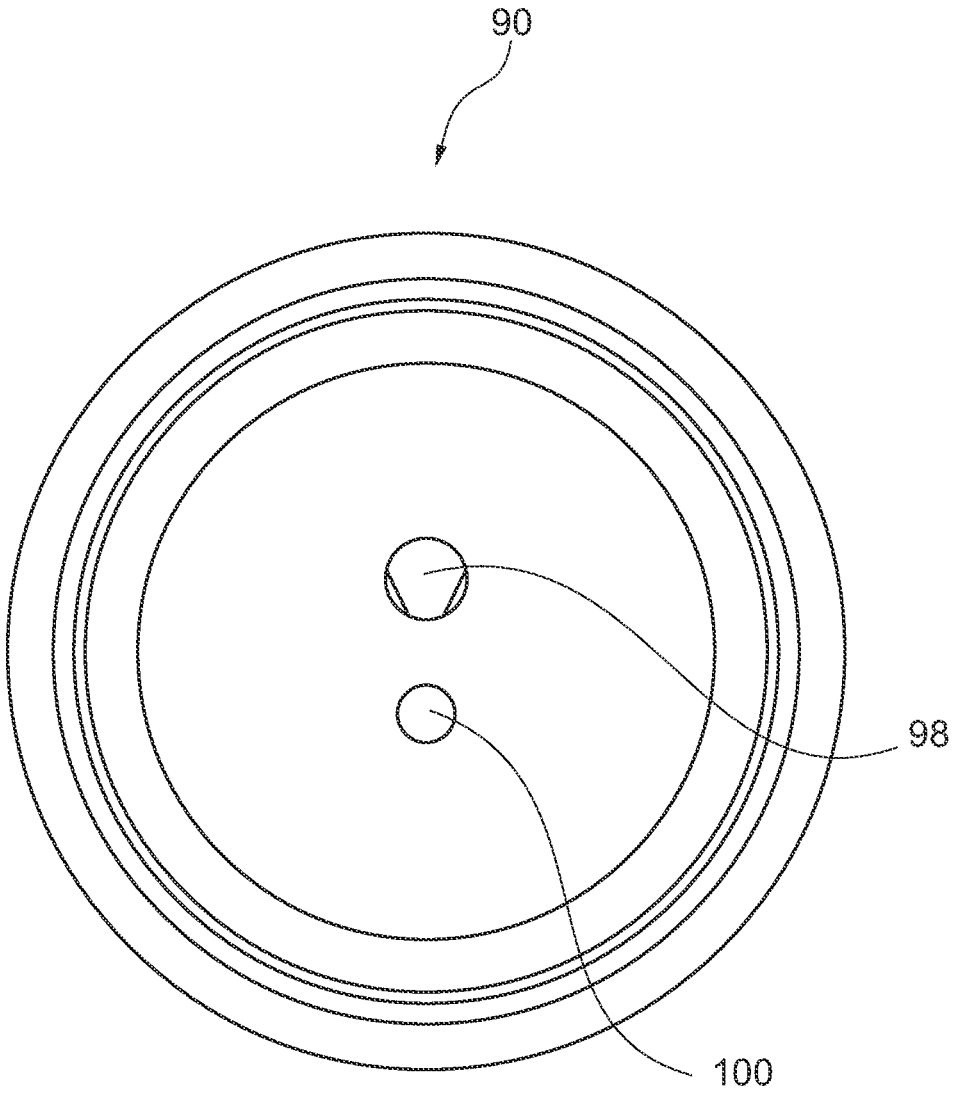
FIG. 23 is a side view of the outer sleeve of the rocker arm assembly of FIG. 22.

FIG. 23 illustrates a side view of the outer sleeve 90 with the recess 94. A hole 98 is formed in the outer sleeve 90 to aid in the rocker arm assembly 10.

Figure 24:
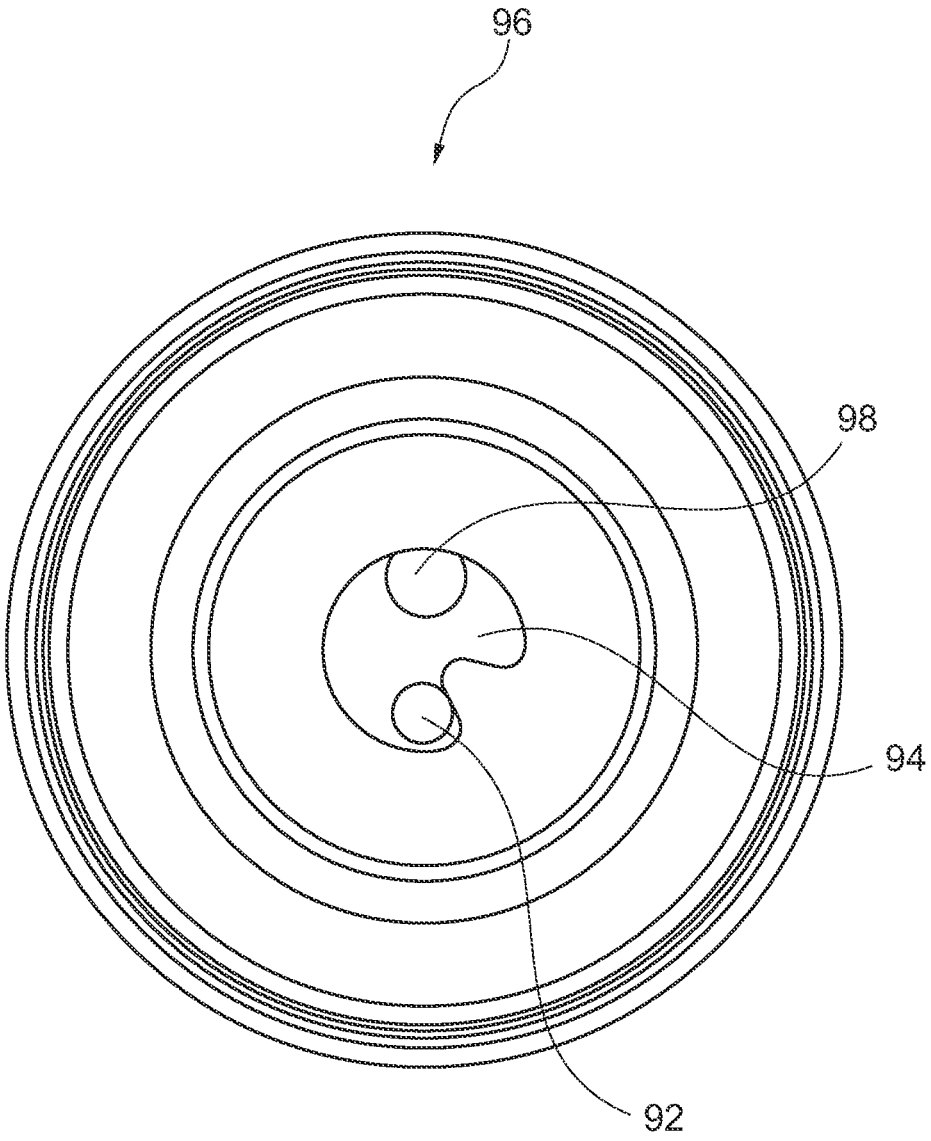
FIG. 24 is a side view of the inner sleeve of the rocker arm assembly of FIG. 22 with the outer sleeve contacting the inner sleeve.

FIG. 24 illustrates a side view of the inner sleeve 96 showing the recess 94 in which the tab 92 of the outer sleeve 90 rotates. The recess 94 is shown as predominately circular with a convex bulge that prevents the support pin 26 from inverting. However, any combination of geometries of the recess 94 and tab 92 are possible.

Figure 25:
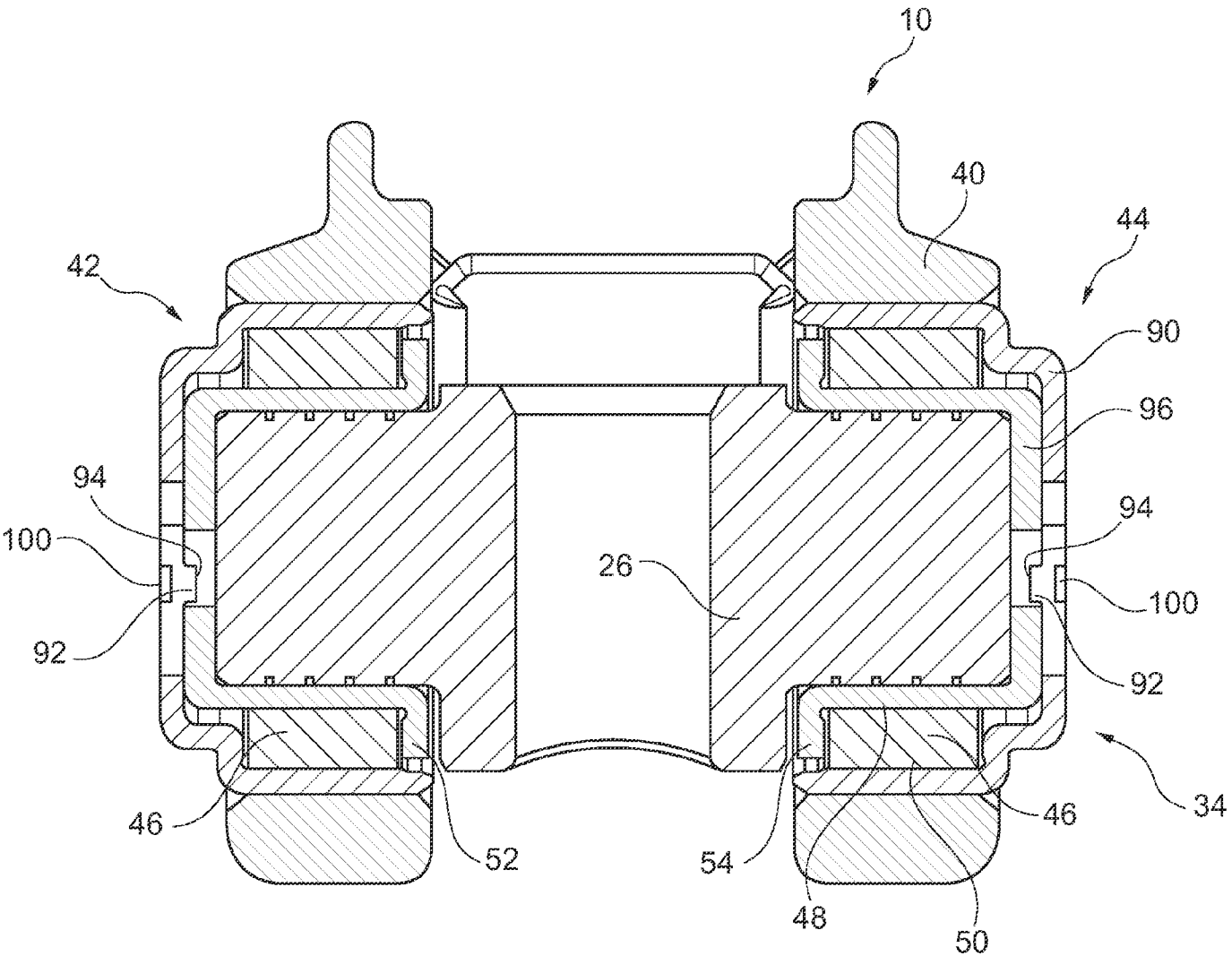
FIG. 25 is a transverse cross-sectional view of the rocker arm assembly of FIG. 22.

FIG. 25 illustrates a transverse cross-sectional view of the rocker arm assembly 10 with the tab 92 of the outer sleeve 90 extending inward into the recess 94 of the inner sleeve 96. As shown, a through-hole 34 passes through sidewalls of the rocker arm 40. The support pin 26, which is fixed to the inner sleeve 96, is positioned in the through-hole 34 and allows the rocker arm 40 to rotate. A bearing 42, 44 is positioned at each axial side of the support pin 26. Each bearing 42, 44 includes the inner sleeve 96, the outer sleeve 90, which is fixed to the rocker arm 40, and rolling elements 46 positioned on raceways 48, 50 formed between the inner sleeve 96 and the outer sleeve 90. The rolling elements 46 are illustrated as generally cylindrical, however, needle rollers or spherical rollers can be employed.

Figure 26:
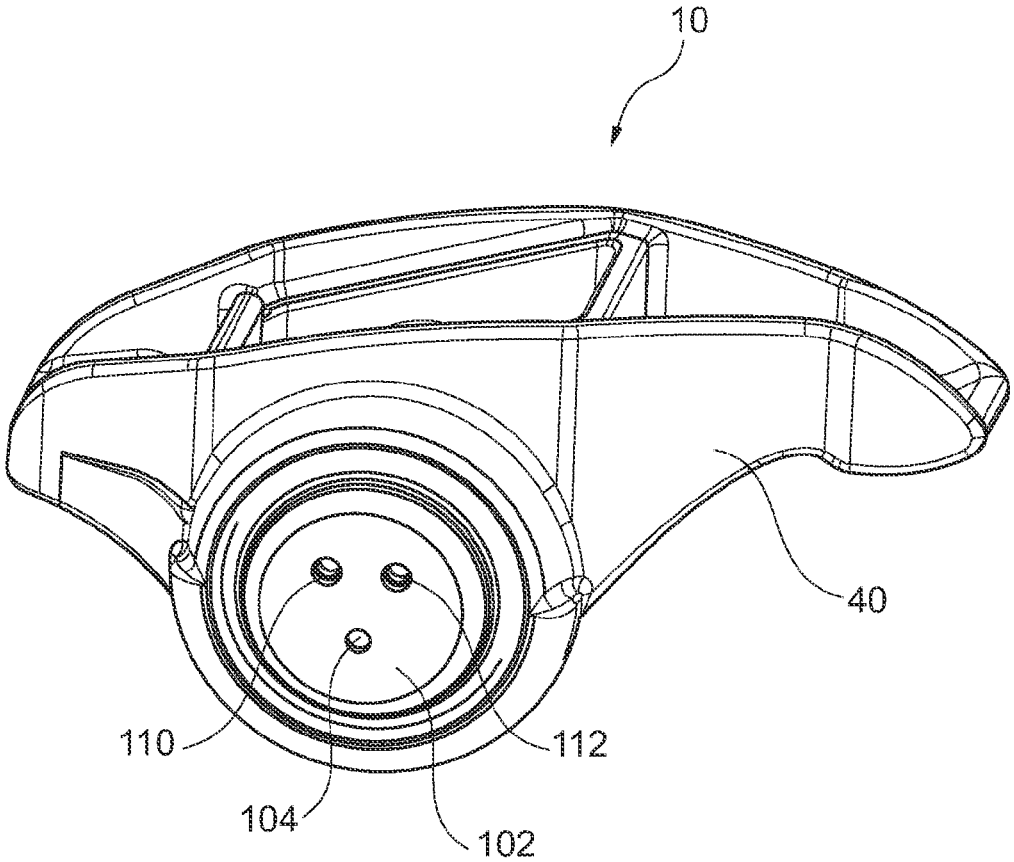
FIG. 26 is a perspective view of the rocker arm assembly with an axially extending anti-inversion feature incorporated onto the outer sleeve, extending into a recess formed in the inner sleeve.

FIG. 26 illustrates a perspective view of the rocker arm assembly 10 with an outer sleeve 102 having a tab 104 that projects axially inboard and rests in a recess 106 formed in an inner sleeve 108. The tab 104 can be incorporated onto one or both sides of the outer sleeve 102. As shown, the tab 104 is predominately circular. The interaction of shapes of the recess 106 on the inner sleeve 108 and the tab 104 on the outer sleeve 102 allows for sufficient clearance to avoid impeding the articulation of the rocker arm 40 during the valve event, while keeping the support pin 26 from completely inverting.

Figure 27:
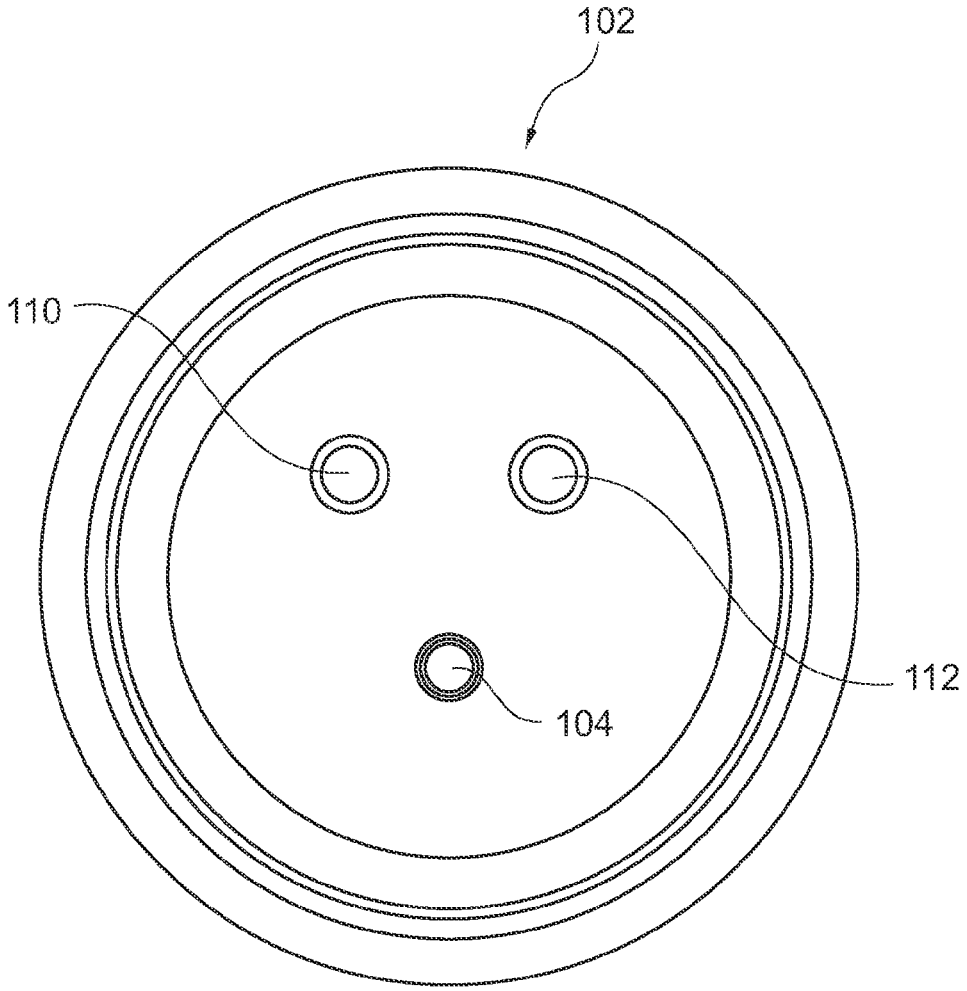
FIG. 27 is a side view of the outer sleeve of the rocker arm assembly of FIG. 26.

FIG. 27 illustrates a side view of the outer sleeve 102 with the recess 106. Holes 110, 112 formed in the outer sleeve 102 aid in the rocker arm assembly 10.

Figure 28:
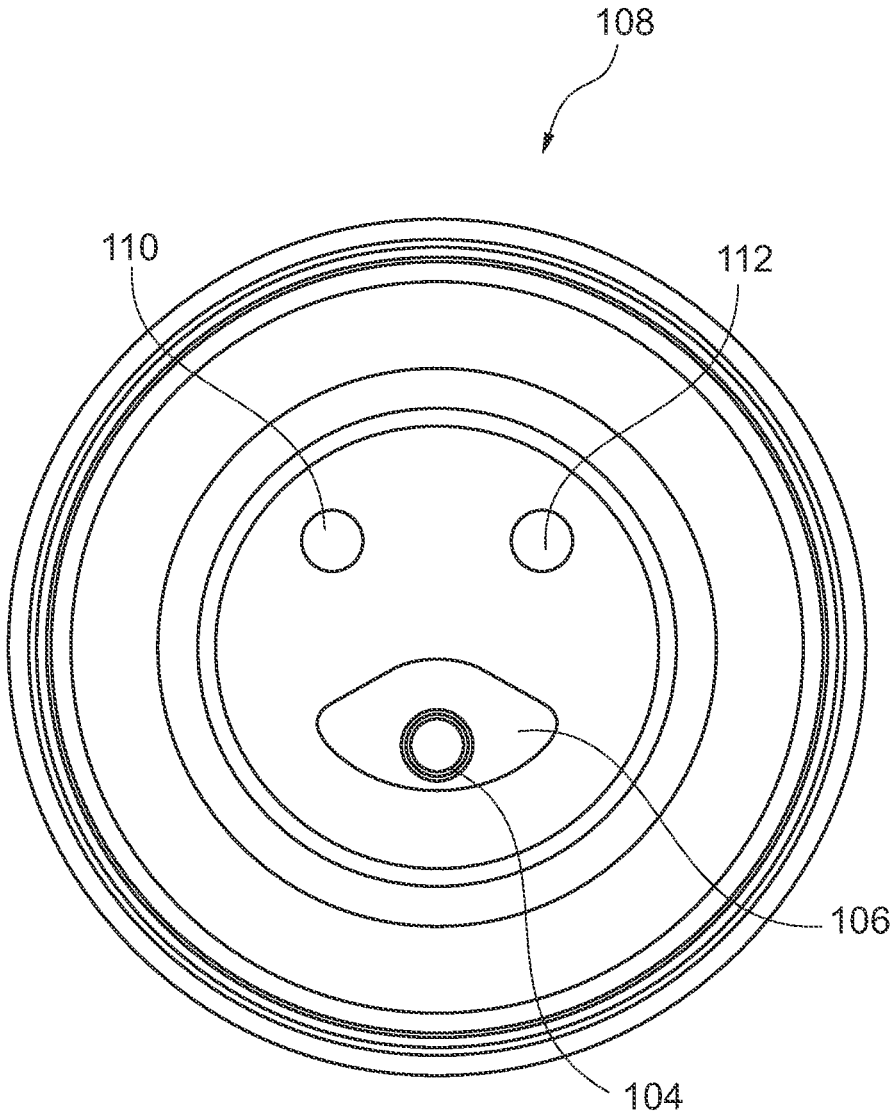
FIG. 28 is a side view of the inner sleeve of the rocker arm assembly of FIG. 26.

FIG. 28 illustrates a side view of the inner sleeve 108 showing the recess 106 in which the tab 104 of the outer sleeve 102 rotates. The recess 106 is shown as predominately elliptical, preventing the support pin 26 from inverting. However, any combination of geometries of the recess 106 and tab 104 are possible.

Figure 29:
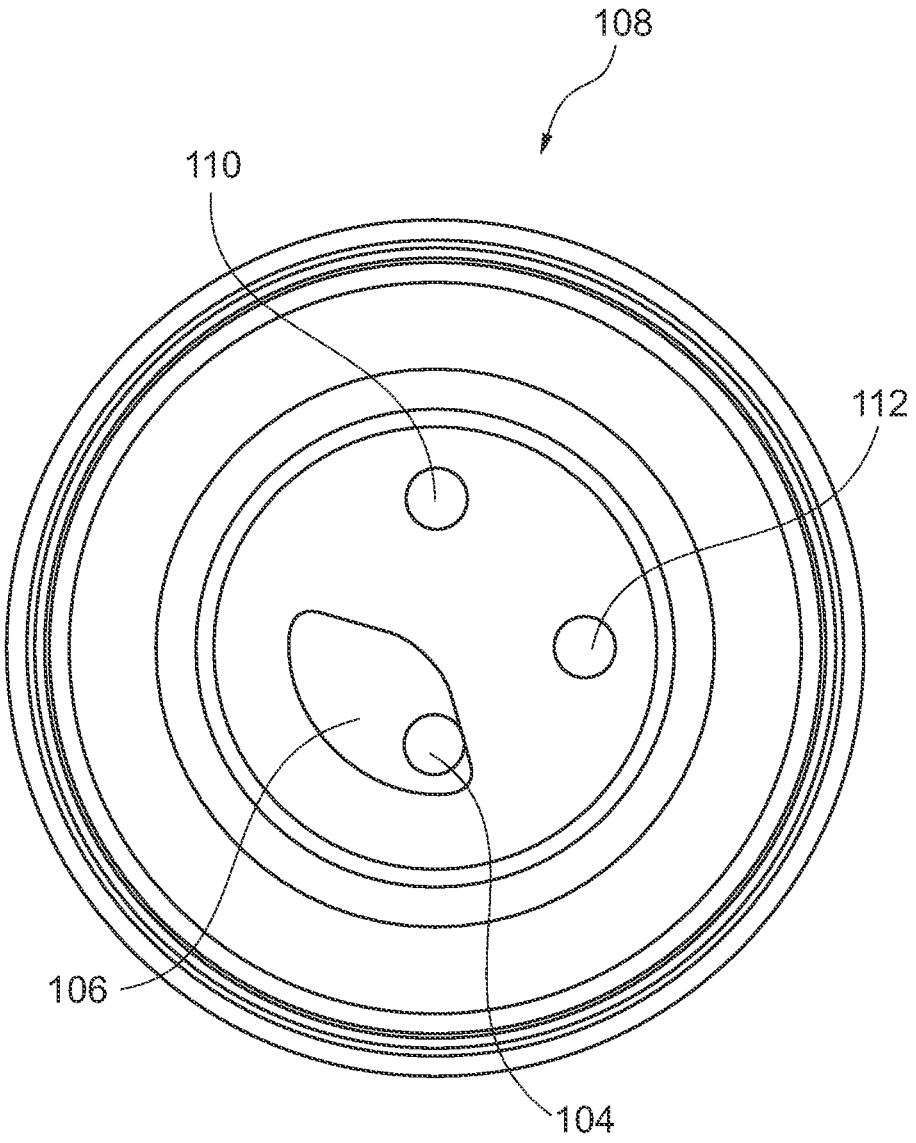
FIG. 29 is a side view of the inner sleeve of the rocker arm assembly of FIG. 26 with the tab of the outer sleeve contacting one of the walls of the recess of the inner sleeve.

FIG. 29 illustrates a side view of the inner sleeve 108 with the tab 104 of the outer sleeve 102 contacting an outer edge of the recess 106 in the inner sleeve 108.

Figure 30:
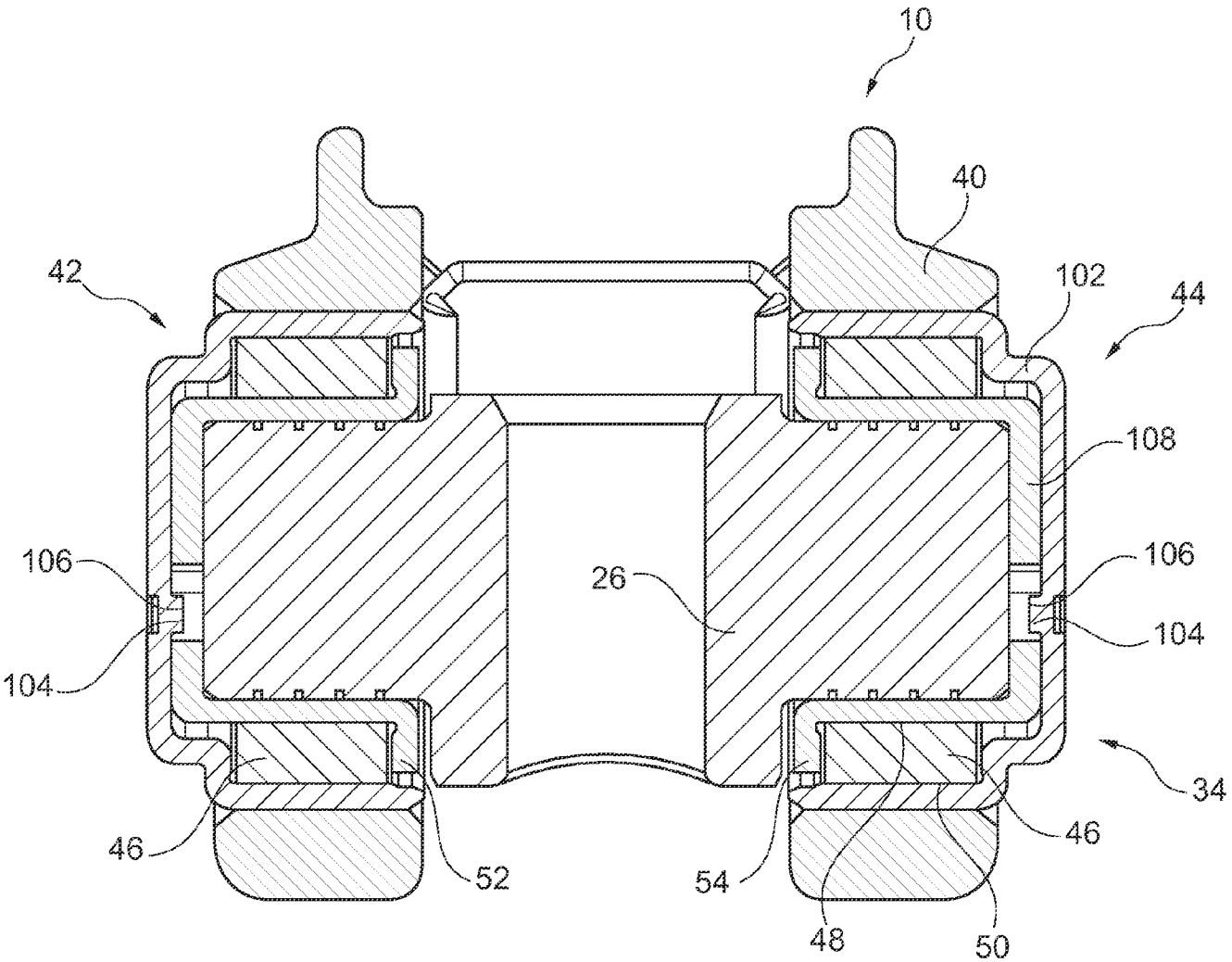
FIG. 30 is a transverse cross-sectional view of the rocker arm assembly of FIG. 26.

FIG. 30 illustrates a transverse cross-sectional view of the rocker arm assembly 10 with the tab 104 of the outer sleeve 102 extending inward into the recess 106 of the inner sleeve 108. As shown, a through-hole 34 passes through rocker arm sidewalls 36, 38. The support pin 26, which is fixed to the inner sleeve 108, is positioned in the through-hole 34 and allows the rocker arm 40 to rotate. A bearing 42, 44 is positioned at each axial side of the support pin 26. Each bearing 42, 44 includes the inner sleeve 108, the outer sleeve 102, which is fixed to the rocker aim 40, and rolling elements 46 positioned on raceways 48, 50 formed between the inner sleeve 108 and the outer sleeve 102. The rolling elements 46 are illustrated as generally cylindrical, however, needle rollers or spherical rollers can be employed.

Figure 31:
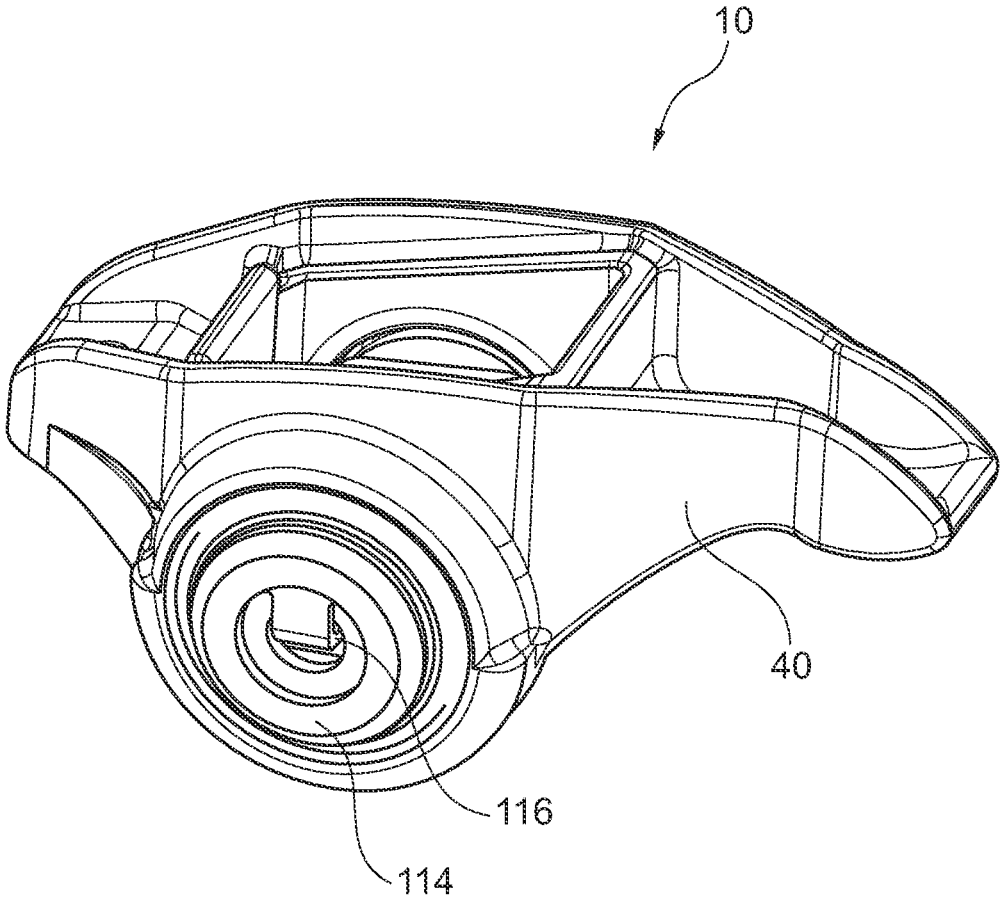
FIG. 31 is a perspective view of the rocker arm assembly with an axially extending anti-inversion feature incorporated onto the outer sleeve, extending into a recess formed in the support pin.

FIG. 31 illustrates a perspective view of the rocker arm assembly 10 with a hole 12 in the outer sleeve 114 from which a tab 116 is formed and bent in a generally axial direction toward the longitudinal centerline of the rocker arm 40. The tab 116 extends through the hole 14 in an inner sleeve 118 and into a recess 120 formed in an end 122 of a support pin 124. The recess 120 has sufficient clearance to avoid impeding the articulation of the rocker arm 40 during the valve event, allowing the support pin 124 to rotate freely, as necessary, until reaching the outer limits of rotation in the recess 120 and contacting the tab 116 of the outer sleeve 114. Thus, the tab 116 of the outer sleeve 114 acts as a stop, preventing inversion of the support pin 124 by contact with one of the recess 120 walls.

Alternatively, articulation limiting geometry could be incorporated into both recesses 120 in the ends 28, 30 of the support pin 124 with the recesses being identical. Different configurations of the recesses 120 allows for easier manufacturability of the overall rocker arm assembly 10 with one end allowing for free rotation of the support pin 124 and the other end configured such that the protrusion of the outer sleeve 114 acts as a stop, preventing inversion of the support pin 124.

While the tab 116 and the anti-inversion recess 120 are shown as generally rectangular, any suitable combination of geometries may be used.

Figure 32:
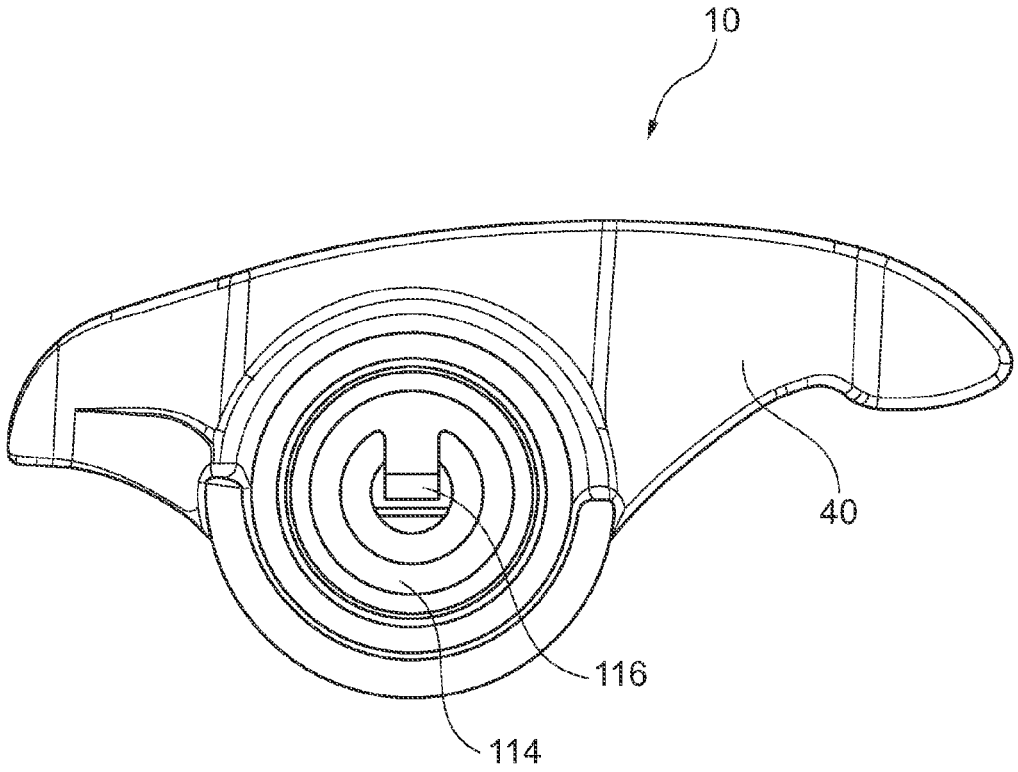
FIG. 32 is a side view of the outer sleeve of the rocker arm assembly of FIG. 31.

FIG. 32 is a side view of the rocker arm assembly 10 showing the tab 116 of the outer sleeve 114 bent inward and extending through the hole 12 in the inner sleeve 118.

Figure 33:
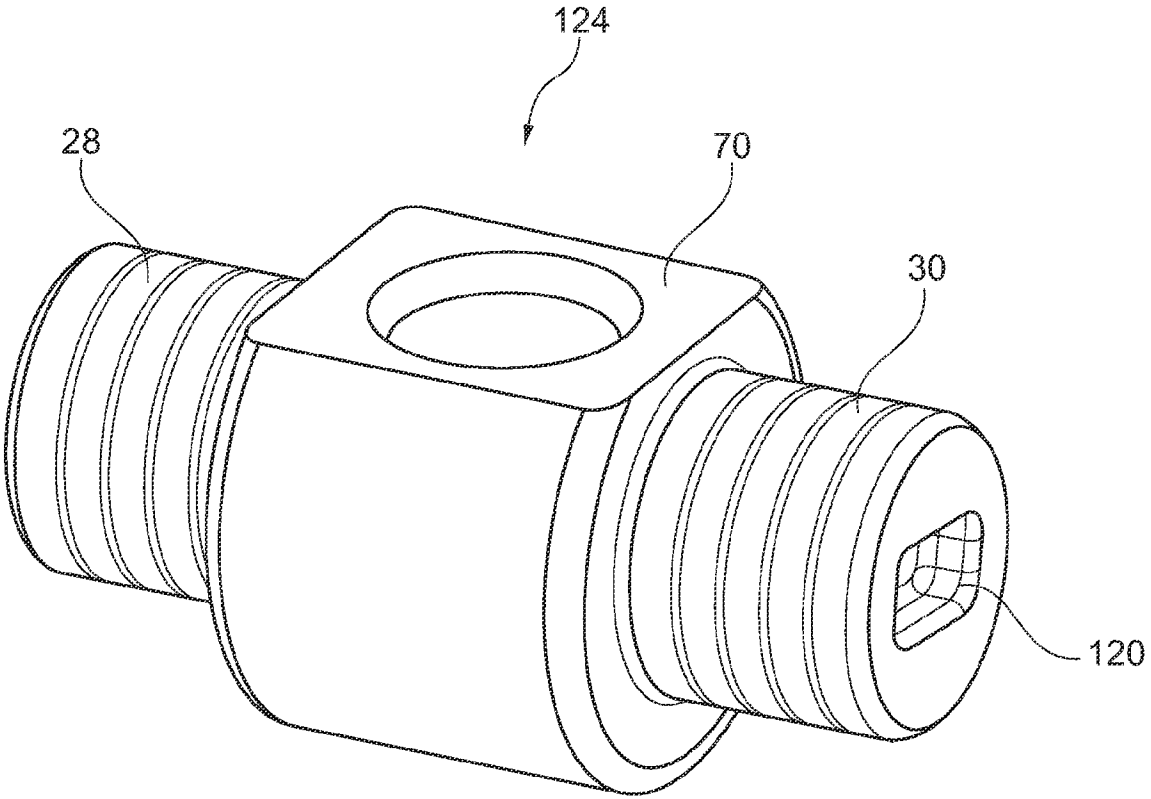
FIG. 33 is a perspective view of a support pin of the rocker arm assembly of FIG. 31.

FIG. 33 illustrates the support pin 124 with recesses 120. The support pin 124 has the central section 70 and the two cylindrical ends 28, 30. The central section 70 is predominately cylindrical with a flat upper surface. The ends 28, 30, which are centrally located on each side of the central section 70, are stepped and narrower in diameter than the central section 70. As shown, the recesses 120 are centrally located in each of the ends 28, 30.

Figure 34:
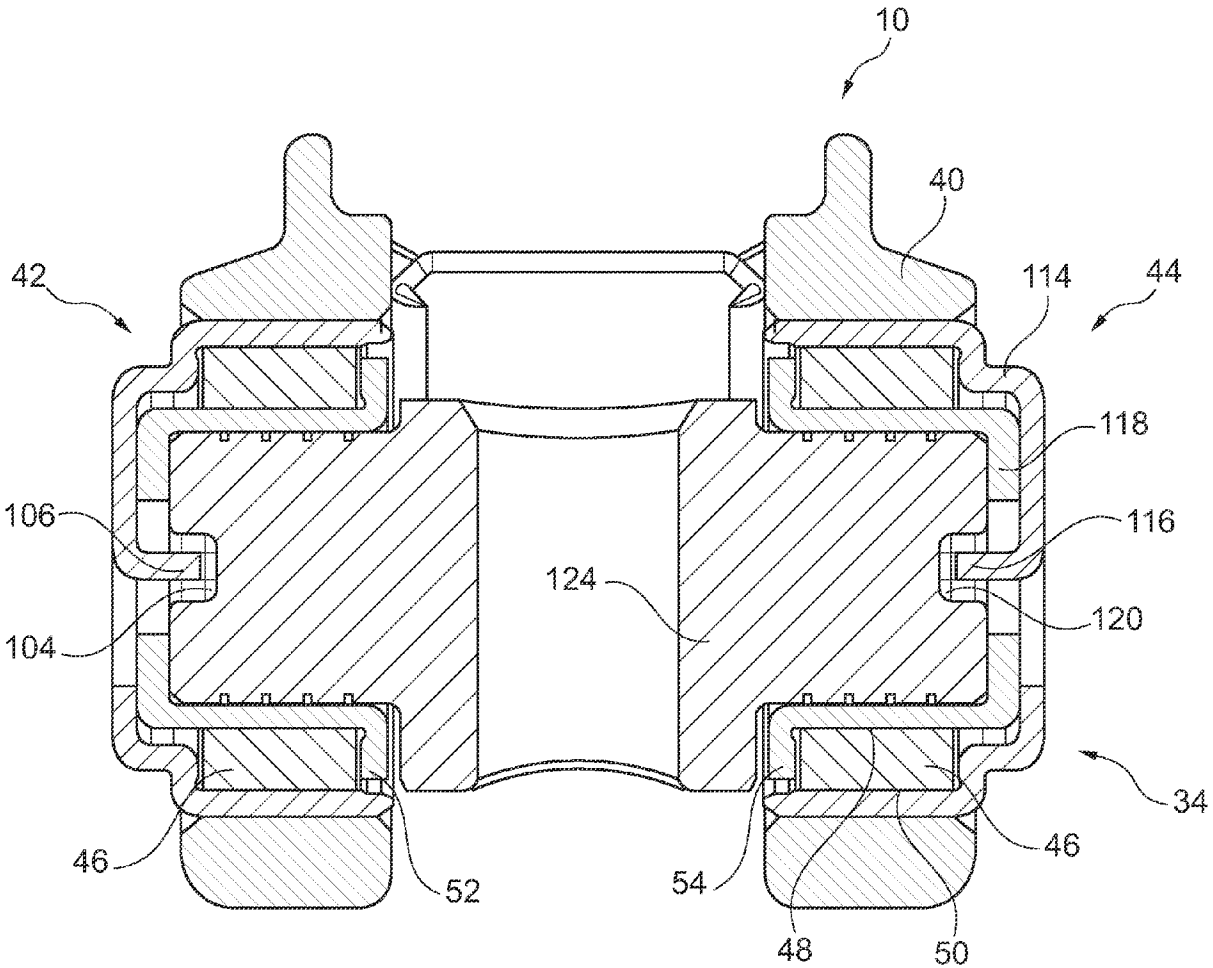
FIG. 34 is a transverse cross-sectional view of the rocker arm assembly of FIG. 31.

FIG. 34 illustrates a transverse cross-sectional view of the rocker arm assembly 10 with the tab 116 of the outer sleeve 114 extending inward. As shown, a through-hole 34 passes through sidewalls of the rocker arm 40. The support pin 124, which is fixed to the inner sleeve 118, is positioned in the through-hole 34 and allows the rocker arm 40 to rotate. A bearing 42, 44 is positioned at each axial side of the support pin 124. Each bearing 42, 44 includes the inner sleeve 118, the outer sleeve 114, which is fixed to the rocker arm 40, and rolling elements 46 positioned on raceways 48, 50 formed between the inner sleeve 118 and the outer sleeve 114. The rolling elements 46 are illustrated as generally cylindrical, however, needle rollers or spherical rollers can be employed.

Alternatively, articulation limiting geometry could be incorporated into both recesses 120 in the ends 28, 30 of the support pin 124 with the recesses being identical. Different configurations of the recesses 120 allows for easier manufacturability of the overall rocker arm assembly 10 with one end allowing for free rotation of the support pin 124 and the other end configured such that the protrusion of the outer sleeve 114 acts as a stop, preventing inversion of the support pin 124.

While the tab 116 and the anti-inversion recess 120 are shown as generally rectangular, any suitable combination of geometries may be used.

Figure 35:
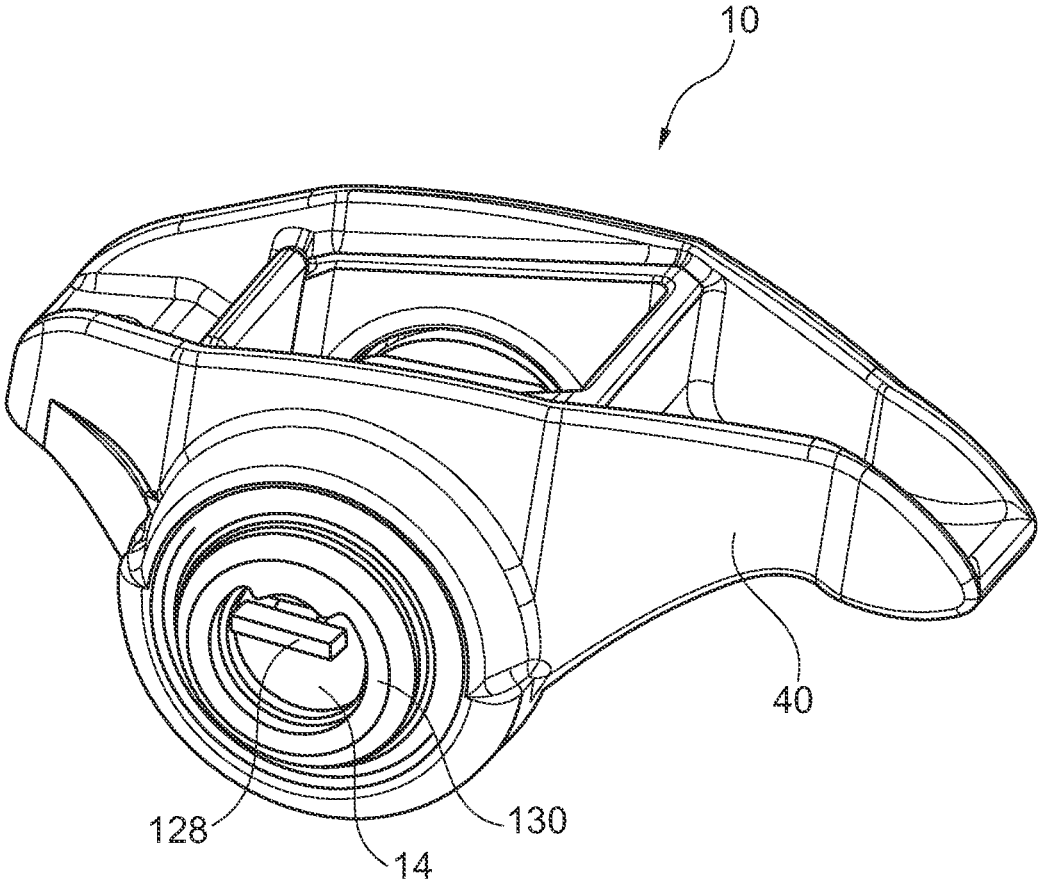
FIG. 35 is a perspective view of the rocker arm assembly with an axially extending anti-inversion feature incorporated on the inner sleeve, extending through a hole formed in the outer sleeve.

FIG. 35 illustrates a perspective view of the rocker arm assembly 10 with a hole 12 in an inner sleeve 126 from which a tab 128 is formed and bent in a generally axial direction away from the longitudinal centerline of the rocker arm 40. The tab 128 extends through the hole 14 in an outer sleeve 130, beyond the outer sleeve 130. The hole 14 in the outer sleeve 130 is predominately circular with a concave portion extending inward. At each side of the concave portion are grooves, which act as stops for the tab 128. However, the hole can be of any shape or configuration. The tab 128 allows the support pin 26 to rotate, as necessary, while preventing the support pin 26 from inverting.

Figure 36:
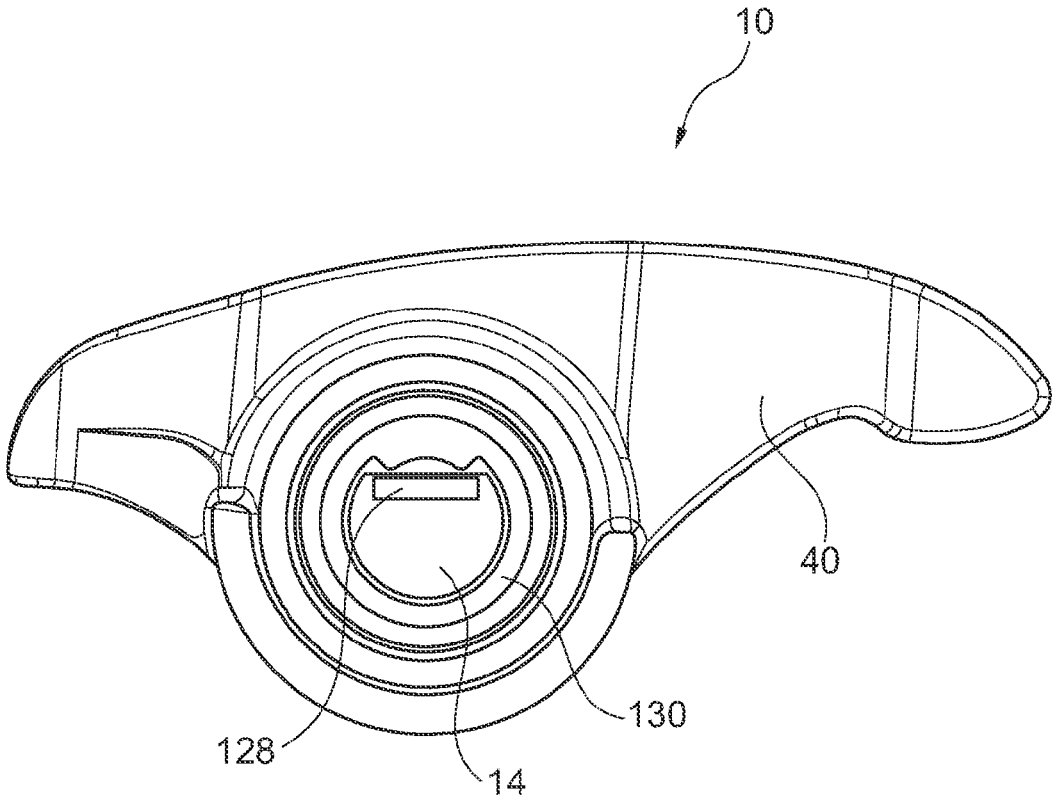
FIG. 36 is a side view of the outer sleeve of the rocker arm assembly of FIG. 35.

FIG. 36 is a side view of the rocker arm assembly 10 showing the tab 128 of the inner sleeve 126 bent outward and extending through the hole 14 in the outer sleeve 130.

Figure 37:
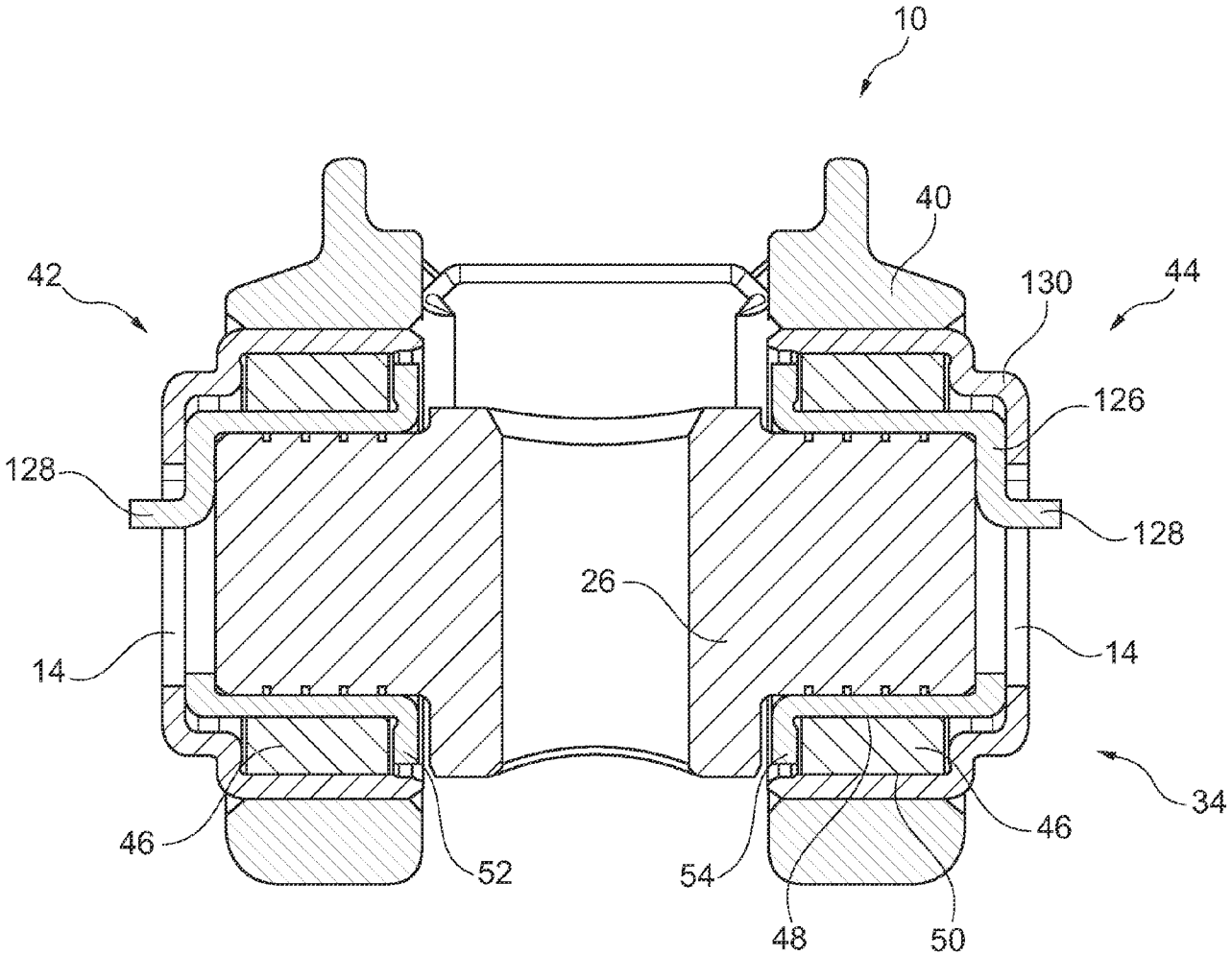
FIG. 37 is a transverse cross-sectional view of the rocker arm assembly of FIG. 35.

FIG. 37 illustrates a transverse cross-sectional view of the rocker arm assembly 10 with the tab 128 of the inner sleeve 126 extending outward. As shown, a through-hole 34 passes through sidewalls of the rocker arm 40. The support pin 26, which is fixed to the inner sleeve 126, is positioned in the through-hole 34 and allows the rocker arm 40 to rotate. A bearing 42, 44 is positioned at each axial side of the support pin 26. Each bearing 42, 44 includes the inner sleeve 126, the outer sleeve 130, which is fixed to the rocker arm 40, and rolling elements 46 positioned on raceways 48, 50 formed between the inner sleeve 126 and the outer sleeve 130. The rolling elements 46 are illustrated as generally cylindrical, however, needle rollers or spherical rollers can be employed.

The hole 14 in the outer sleeve 130 can be configured larger than the hole 12 on the inner sleeve 126, permitting the bearing 42, 44 to be installed into the rocker arm 40 as an assembly using a stepped tool to maintain a specified axial clearance between the thrust surfaces of inner sleeve 126 and the outer sleeve 130 and minimizing rocker arm assembly steps and allowing for free rotation. Moreover, while the tab 128 is shown as generally rectangular, any suitable combination of geometries may be used. Furthermore, tabs 128 can be formed on one or both sides of the rocker arm 40.

Figure 38:
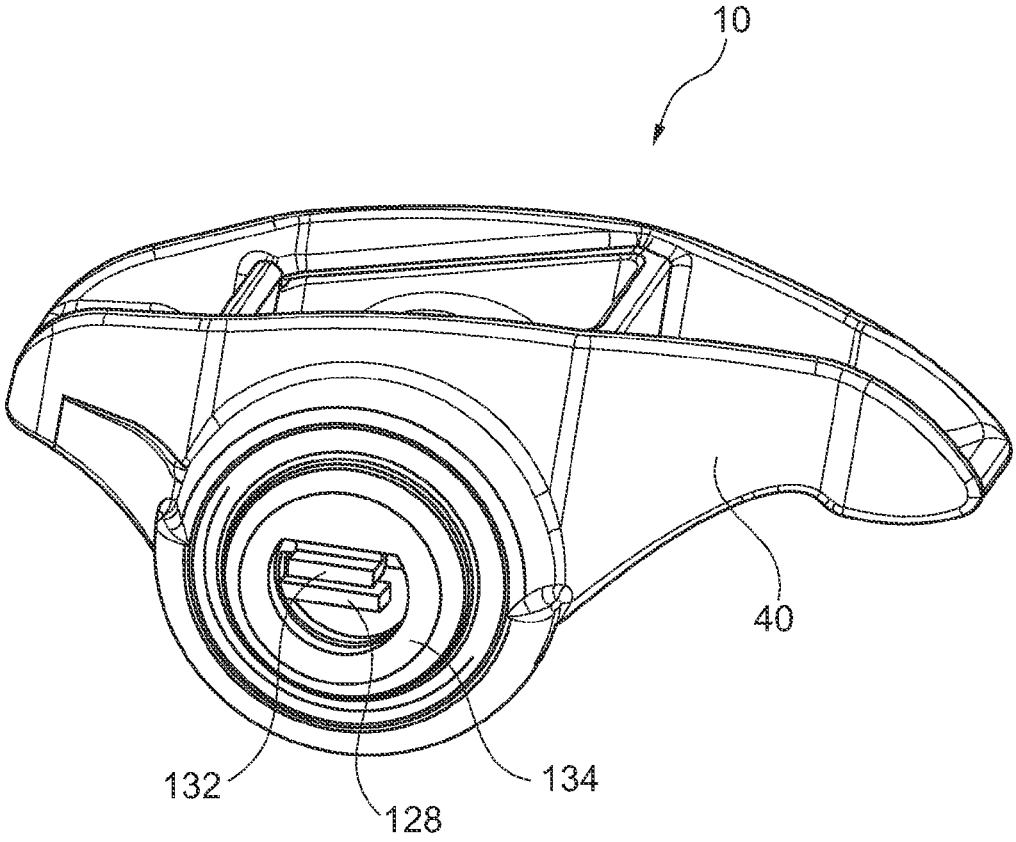
FIG. 38 is a perspective view of the rocker arm assembly with an axially extending anti-inversion feature incorporated on the inner sleeve and the outer sleeve, extending outward.

FIG. 38 illustrates a perspective view of the rocker arm assembly 10 with a tab 128 formed on the inner sleeve 126 and a tab 132 formed on an outer sleeve 134, each extending in a general axial direction, in offset planes, away from the longitudinal centerline of the rocker arm 40. The geometries of the tabs 128, 132 and offset spacing are configured such that the angular motion of the inner sleeve 126 relative to the tab 132 of the outer sleeve 134 is intentionally limited by contact of the tabs 128, 132, preventing inversion of the support pin 26. Thus, the tab 132 of the outer sleeve 134 acts as a stop for the tab 128 of the inner sleeve 126 to prevent inversion of the support pin 26.

Figure 39:
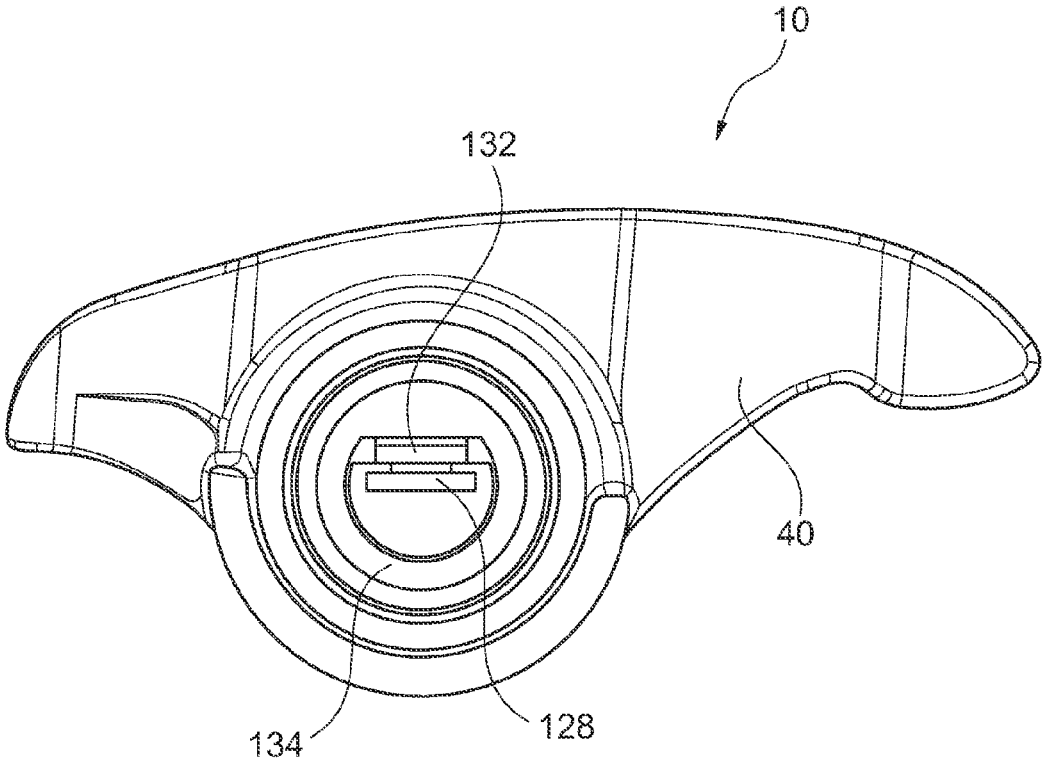
FIG. 39 is a side view of the outer sleeve of the rocker arm assembly of FIG. 38.

FIG. 39 is a side view of the rocker arm assembly 10 showing the tab 132 of the outer sleeve 134 and tab 128 of the inner sleeve 126.

Figure 40:
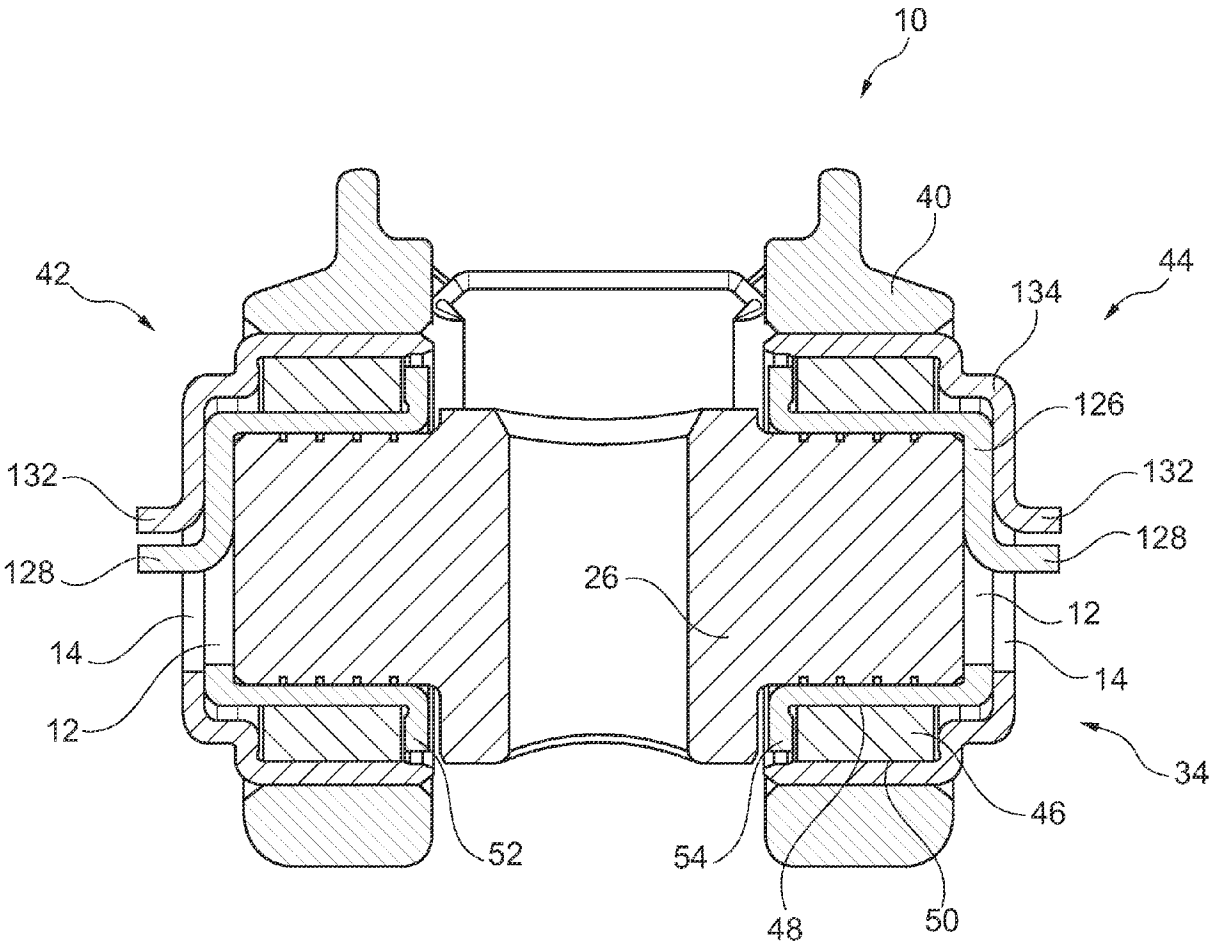
FIG. 40 is a transverse cross-sectional view of the rocker arm assembly of FIG. 38.

FIG. 40 illustrates a transverse cross-sectional view of the rocker arm assembly 10 with the tab 128 of the inner sleeve 126 and the tab 132 of the outer sleeve 134 extending outward. As shown, a through-hole 34 passes through sidewalls of the rocker arm 40. The support pin 26, which is fixed to the inner sleeve 126, is positioned in the through-hole 34 and allows the rocker arm 40 to rotate. A bearing 42, 44 is positioned at each axial side of the support pin 26. Each bearing 42, 44 includes the inner sleeve 126, the outer sleeve 134, which is fixed to the rocker arm 40, and rolling elements 46 positioned on raceways 48, 50 formed between the inner sleeve 126 and the outer sleeve 134. The rolling elements 46 are illustrated as generally cylindrical, however, needle rollers or spherical rollers can be employed.

Additionally, the hole 14 on the outer sleeve 134 can be configured larger than the hole 12 on the inner sleeve 126, permitting the bearings 42, 44 to be installed into the rocker arm 40 as an assembly using a stepped tool to maintain a specified axial clearance between the thrust surfaces of inner sleeve 126 and the outer sleeve 134 and minimizing rocker assembly steps and allowing for free rotation.

For all embodiments, retention flanges 52, 54 (shown on the inner sleeve) can be formed on either the inner sleeve or the outer sleeve to retain the rolling elements 46. The flanges 52, 54 help to maintain the orientation and, thus, functionality of the rolling elements 46. Also, while it is advantageous to incorporate axial retention flanges in each bearing sleeve, it is possible to incorporate both into a single bearing sleeve.

Furthermore, etchings could be utilized on the thrust surfaces of support pin, inner sleeve and outer sleeve to promote oil flow. Also, coatings may be applied to the thrust surfaces modify friction characteristics and improve oil retention and durability. Such coatings may include, but are not limited to, various phosphates, Teflon®, and diamond-like coatings known as C+ and C++. A low friction washer (not shown) made of Torlon®, Teflon®, graphite Oilite®, or other suitable material, may be incorporated between the thrust surfaces if needed as well.

The present invention has been described with reference to a preferred embodiment. It should be understood that the scope of the present invention is defined by the claims and is not intended to be limited to the specific embodiment disclosed herein.

REFERENCE CHARACTERS

10 Rocker Arm Assembly
12 Hole in Inner Sleeve
14 Hole in Outer Sleeve
16 Thrust Surface of Inner Sleeve
18 Thrust Surface of Outer Sleeve
20 Inner sleeve
22 Outer Sleeve
24 Tab
26 Support Pin
28 End of Support Pin
30 End of Support Pin
32 Walls
34 Through-hole
40 Rocker Arm
42 Bearing
44 Bearing
46 Rolling Elements
48 Raceway
50 Raceway
52 Flange
54 Flange
56 Hole in Inner Sleeve
58 Hole in Outer Sleeve
60 Thrust Surface
62 Thrust Surface
64 Tab
66 Walls
68 Thrust Surface

70 Central Section
72 Inner Sleeve
74 Tab
76 Recess
78 Outer Sleeve
80 Through Hole
84 Recess
86 Inner Sleeve
88 Tab
90 Outer Sleeve
92 Tab
94 Recess
96 Inner Sleeve
98 Hole
100 Recess
102 Outer Sleeve
104 Tab
106 Recess
108 Inner Sleeve
110 Hole
112 Hole
114 Outer Sleeve
116 Tab
118 inner Sleeve
120 Recess
122 End
124 Support Pin
126 Inner Sleeve
128 Tab
130 Outer Sleeve
132 Tab
134 Outer Sleeve

What is claimed:

1. A rocker arm assembly for use in an internal combustion engine, comprising:

a rocker arm having a transverse through-hole;

a support pin being positioned in the through-hole and about which the rocker arm rocks;

a bearing positioned at each end of the support pin in the through-hole between the support pin and the rocker arm, the bearing having an outer sleeve, an inner sleeve and roller elements therebetween, the outer sleeve abutting an inner circumferential wall of the through-hole, and having an outer bearing wall that extends radially inward and covers the through-hole, the inner sleeve abutting an outer circumferential wall of the support pin, and having an inner bearing wall that extends radially inward and covers an axial end wall of the support pin, the outer bearing wall abutting the inner bearing wall to accommodate axial loads, the rolling elements positioned between and in contact with the inner sleeve and outer sleeve to accommodate radial loads; and a means for preventing inversion of the support pin, wherein the means for preventing inversion of the support pin is a combination of the support pin and at least one of the inner sleeve and the outer sleeve.

2. The assembly of claim 1, wherein the support pin has a central section and two ends, the central section having a smooth, cylindrical surface and the ends, which are located on each side of the central section, being stepped and narrower in diameter than the central section.

3. The assembly of claim 2, wherein the support pin is selected from a group consisting of a support pin where the ends are of flat or linear form, a support pin having a tab extending from at least one of the ends of the support pin and a support pin having recesses in each of the ends of the support pin.

4. The assembly of claim 3, wherein the tab of the support pin, which is D-shaped, extends outboard of the rocker arm assembly through a hole in a thrust surface of the inner sleeve and a hole in a thrust surface of the outer sleeve, the hole in the outer sleeve is predominately cylindrical with a wave-like upper wall which has recesses at each end that act as stops, and the tab is configured such that angular motion of the tab is limited by contact with at least one of the recesses, preventing inversion of the support pin.

5. The assembly of claim 3, wherein the tab of the support pin, which is predominately rectangular, extends outboard of the rocker arm assembly through a hole in a thrust surface of the inner sleeve and a hole in a thrust surface of the outer sleeve, the hole in the outer sleeve is predominately cylindrical with a convex upper wall that acts as a stop and the tab is configured such that angular motion of the tab is limited by contact with the upper wall, preventing inversion of the support pin.

6. The assembly of claim 3, wherein retention flanges are formed on the inner sleeve and/or the outer sleeve to retain the rolling bodies located between the inner sleeve and outer sleeve.

7. The assembly of claim 3, wherein the outer sleeve has a recess in which the tab, which is circular, rests and which is configured to limit angular motion of the tab by contact with at least one wall of the recess, preventing inversion of the support pin.

8. The assembly of claim 7, wherein, to accommodate the recess, the outer sleeve forms a bulge that protrudes in an outboard direction.

9. The assembly of claim 3, wherein the inner sleeve has at least one D-shaped or semi-circular tab which extends outboard of the rocker arm assembly through a hole in a thrust surface of the outer sleeve and the inner sleeve has a recess which opposes the tab of the inner sleeve.

10. The assembly of claim 9, wherein the hole in the outer sleeve is predominately cylindrical with a wave-like upper wall which has recesses at each end that act as stops and the tab is configured such that angular motion of the tab is limited by contact with at least one of the recesses, preventing inversion of the support pin.

11. The assembly of claim 3, wherein the outer sleeve has a tab that extends inboard of the rocker arm assembly into a recess formed in the inner sleeve.

12. The assembly of claim 11, wherein the recess in the inner sleeve is predominately cylindrical with a convex protrusion acting as a stop.

13. The assembly of claim 11, wherein the recess in the inner sleeve is elliptical.

14. The rocker arm assembly of claim 3, wherein the outer sleeve has a hole from which a tab is formed that is bent inwardly in a general axial direction and extends transversely beyond a hole in the inner sleeve and into one of the recesses of the support pin such that one of the recesses in which the tab of the outer sleeve extends acts as the stop, preventing the support pin from inverting by contact of the tab with one of the walls of the one of the recesses.

15. The rocker arm assembly of claim 3, wherein the inner sleeve has a hole from which a tab is formed that is bent outwardly in a generally axial direction and extends transversely through a hole formed in the outer sleeve such that the support pin and the inner sleeve can rotate freely in the hole of the outer sleeve over a specified range of motion.

16. The rocker arm assembly of claim 3, wherein holes are incorporated into both the inner sleeve and the outer sleeve from which a tab is formed on the inner sleeve and a tab is formed on the outer sleeve, each tab is bent outwardly in a general axial direction in offset planes and the tab of the outer sleeve acts as a stop for the tab of the inner sleeve, preventing inversion of the support pin.

17. The rocker arm assembly of claim 16, wherein the tab of the inner sleeve and the tab of the outer sleeve are configured such that the support pin and the inner sleeve can rotate freely in the hole of the outer sleeve over a specified range of angular motion relative to the tab of the outer sleeve and the support pin and the inner sleeve are limited by contact of the tab of the inner sleeve with the tab of the outer sleeve, which prevents inversion of the support pin.

18. The rocker arm assembly of claim 1, wherein retention flanges are formed on the inner sleeve and the outer sleeve and retain the rolling bodies.

* * * * *